US010449396B2

(12) United States Patent
Renton et al.

(10) Patent No.: US 10,449,396 B2
(45) Date of Patent: Oct. 22, 2019

(54) PERSONAL HEIGHT RESCUE APPARATUS

(71) Applicant: FALLSAFE LIMITED, Lymington, Hampshire (GB)

(72) Inventors: Julian Elwyn Renton, Wiltshire (GB); Peter Thomas Mence Nott, Wingfield (GB)

(73) Assignee: FALLSAFE LIMITED, Hampshire (GB)

( * ) Notice: Subject to any disclaimer, the term of this patent is extended or adjusted under 35 U.S.C. 154(b) by 387 days.

(21) Appl. No.: 15/217,830

(22) Filed: Jul. 22, 2016

(65) Prior Publication Data

US 2016/0332007 A1 Nov. 17, 2016

Related U.S. Application Data

(63) Continuation of application No. 11/568,879, filed as application No. PCT/GB2005/001862 on May 13, 2005, now Pat. No. 9,427,607.

(30) Foreign Application Priority Data

May 15, 2004 (GB) ..... 0410957.5
Jun. 8, 2004 (GB) ..... 0412700.7
(Continued)

(51) Int. Cl.
*A62B 1/14* (2006.01)
*A62B 1/08* (2006.01)
(Continued)

(52) U.S. Cl.
CPC ..... *A62B 1/14* (2013.01); *A62B 1/08* (2013.01); *A62B 1/10* (2013.01); *A62B 35/0037* (2013.01); *A62B 35/0093* (2013.01)

(58) Field of Classification Search
CPC ..... A62B 1/14
(Continued)

(56) References Cited

U.S. PATENT DOCUMENTS 191,118 A * 5/1877 Post ..... A62B 1/10 182/240
193,259 A * 7/1877 holman ..... A62B 1/14 182/7
(Continued)

FOREIGN PATENT DOCUMENTS

DE 2117942 10/1972
DE 4232107 3/1994
(Continued)

OTHER PUBLICATIONS

Search Report issued in corresponding Great Britain Patent Application No. GB0509914.8 dated Jun. 30, 2005, consisting of 1 pp.
(Continued)

*Primary Examiner* — Katherine W Mitchell
*Assistant Examiner* — Candace L Bradford
(74) *Attorney, Agent, or Firm* — Volpe and Koenig, P.C.

(57) ABSTRACT

There is provided height rescue apparatus comprising a casing which incorporates a bracket for attachment to a harness. The bracket can be releasably attached to a load element which is attached to a safety line which in turn can be attached to a secure anchorage. There is also a release means in the form of a pull cord for releasing the load element from the bracket after a fall and speed control means for controlling the rate of deployment of an elongate element stored within the casing and thus controlling the descent of a user.

20 Claims, 23 Drawing Sheets

(30) Foreign Application Priority Data

Jul. 26, 2004 (GB) ..... 0416555.1
Jul. 30, 2004 (GB) ..... 0417013.0
Oct. 14, 2004 (GB) ..... 0422835.9

(51) Int. Cl.
*A62B 1/10* (2006.01)
*A62B 35/00* (2006.01)

(58) Field of Classification Search
USPC ..... 182/234, 239, 73, 236, 237, 240, 71, 72
See application file for complete search history.

(56) References Cited

U.S. PATENT DOCUMENTS 456,281 A * 7/1891 Athey ..... A62B 1/10 182/235
859,266 A 7/1907 Ulery
1,122,566 A 12/1914 Bailey
1,352,230 A * 9/1920 Vescovi ..... A62B 1/14 182/240
1,472,446 A * 10/1923 Wanderley ..... A62B 1/08 182/237
1,494,467 A * 5/1924 Edwards ..... A62B 1/10 182/240
2,500,884 A * 3/1950 Tessin ..... A62B 1/10 182/238
2,515,325 A * 7/1950 Wylie ..... A62B 1/10 182/240
2,561,832 A 7/1951 Wilson
2,729,425 A 1/1956 Gschwind
2,744,673 A * 5/1956 Freeland ..... A62B 1/06 182/3
2,855,028 A * 10/1958 Matthews ..... B60R 22/357 182/73
3,235,031 A * 2/1966 Cenker ..... A62B 1/06 182/5
3,306,582 A * 2/1967 Copeland ..... A62B 1/10 182/240
3,630,488 A * 12/1971 Stangl ..... A62B 1/10 182/231
3,760,910 A 9/1973 Koshihara
3,915,432 A 10/1975 Bustamante
4,171,795 A 10/1979 Bianchi
4,253,218 A * 3/1981 Gibbs ..... A62B 1/14 182/5
4,301,892 A 11/1981 Arce
4,437,546 A * 3/1984 Marinoff ..... A62B 1/12 182/233
4,511,123 A * 4/1985 Ostrobrod ..... A62B 35/0093 182/234
4,588,045 A * 5/1986 Walker, Sr. ..... A62B 1/06 182/191
4,645,034 A * 2/1987 Griffith ..... A62B 35/04 182/231
4,730,703 A * 3/1988 Neuendorf ..... A62B 1/10 182/235
4,877,110 A * 10/1989 Wolner ..... A62B 35/0093 182/232
4,938,435 A * 7/1990 Varner ..... A62B 1/08 182/231
5,042,613 A * 8/1991 Hermann ..... A62B 3/00 182/18
5,060,758 A * 10/1991 Ishioka ..... A62B 1/10 182/234
5,076,394 A * 12/1991 Sheu ..... A62B 1/00 182/5
5,343,976 A 9/1994 Ostrobrod
5,682,962 A * 11/1997 Lo ..... A62B 1/10 182/235
6,763,913 B1 * 7/2004 Adams ..... A62B 35/0093 182/231
7,513,334 B2 * 4/2009 Calver ..... B66D 1/7415 182/133
8,226,024 B2 * 7/2012 Meillet ..... A62B 1/08 242/377
8,413,763 B2 * 4/2013 Hermann ..... A62B 99/00 182/18
9,616,255 B1 * 4/2017 Liddle ..... A62B 35/0062
9,827,451 B2 * 11/2017 Renton ..... A62B 1/10
2003/0159884 A1 * 8/2003 Cole ..... E04G 3/24 182/145
2004/0245048 A1 * 12/2004 Ribic ..... A62B 1/06 182/231
2005/0039979 A1 2/2005 Gorman
2005/0217937 A1 * 10/2005 Rohlf ..... A62B 1/16 182/232
2006/0113147 A1 * 6/2006 Harris, Jr. ..... A62B 35/0093 182/3
2007/0158139 A1 * 7/2007 Moon ..... A62B 1/12 182/238
2009/0173578 A1 * 7/2009 Renton ..... A62B 1/08 182/235
2009/0211849 A1 * 8/2009 Smith ..... A62B 35/0037 182/231

FOREIGN PATENT DOCUMENTS

FR 2387660 A1 11/1978
GB 05882 5/1911
GB 799174 8/1958
GB 2143495 A 2/1985
GB 2306107 A 4/1997
GB 2374552 A * 10/2002 ..... A62B 35/0093
GB 2407611 A * 5/2005 ..... A62B 1/20
GB 2414005 A * 11/2005 ..... A62B 1/10
GB 2414005 A 11/2005
JP 58-192558 A1 11/1983
JP 200268676 A 3/2002
WO 9110475 A1 7/1991
WO 03041799 A1 5/2003

OTHER PUBLICATIONS

Examination Report issued in corresponding Great Britain Patent Application No. GB0509914.8 dated May 18, 2007, consisting of 4 pp.
English Translation of Office Action mailed in corresponding Japanese Patent Application No. 2011-216614 dated Feb. 19, 2013, consisting of 5 pp.
Office Action issued in corresponding European Patent Application No. 05744384.8 dated Feb. 21, 2013, consisting of 4 pp.

* cited by examiner

PERSONAL HEIGHT RESCUE APPARATUS

CROSS REFERENCE

This application is a continuation of U.S. patent application Ser. No. 11/568,879, filed Jul. 28, 2008, which was a 371 National Stage Entry of PCT/GB2005/001862, filed May 13, 2005, both of which are incorporated by reference as if fully set forth.

FIELD

This invention relates to a personal height rescue apparatus to lower a person to safety after being arrested and suspended at height following a fall whilst attached to fall arrest equipment. In particular, this invention relates to a personal height rescue apparatus that is physically associated with a person whilst working at height as well as in the event of the person being arrested following a fall from height whereupon the personal height rescue apparatus enables such a person to be lowered to safety whether to the ground or some other safe level.

BACKGROUND

Personnel working at height are normally required to wear a body harness. The body harness is entwined around parts of the wearer's body in order to ensure that the wearer's body is held securely within the body harness. The body harness is typically attached to one end of a lanyard and the other end of the lanyard is then attached to a secure anchorage. An alternative arrangement is where the body harness is attached to a line that can be extracted from or retracted into a drum that can rotate within a housing that is then attached to a secure anchorage. Extraction of the line from the drum is normally achieved by pulling the line whereas retraction of the line into the drum occurs automatically due to the action of a torsion spring tending to rotate the drum to retract the line. If the line is extracted from the drum quickly, as would be the condition in a fall event, pawls within the housing engage on the drum and stop the drum from any further rotation until the load on the line due to the pulling action is removed. The secure anchorage could be any appropriate anchorage on a structure or building or it could be part of a further fall arrest system such as a cable system whereby the secure anchorage may be able to move along the length of the cable whilst the anchorage is securely attached to said cable thereby allowing access to areas within the proximity of the length of the cable. In any fall arrest arrangement, it is usual for an energy absorber to be attached between the body harness and secure anchorage and for deployment of such an energy absorber to be achieved within a given load limit in order to limit loading on the body of the faller. Many lanyards have a flat rectangular cross section and the energy absorber is incorporated by folding and then stitching together a part of the length of the lanyard such that when the lanyard is subjected to a sufficient tensile loading between either end, the stitching progressively breaks causing the effective length of the lanyard to extend whilst such tensile loading is sustained thereby absorbing energy. The energy absorber associated with the line extracted from or retracted onto a drum is often incorporated between the drum and its housing by allowing the drum to rotate to extract line from the drum after the pawls have engaged on condition that the tensile loading on the line exceeds a threshold limit that is less than the given limit for loading on the body of the faller. The threshold load is often mechanically determined by friction applied between the drum and it's housing whereby the drum can rotate if, and as long as, the load on the line is sufficient to overcome the resisting load due to the friction.

Fall arrest systems and equipment generally allow a person to access the edge of a building or structure where there is a possibility of a fall occurring. In the unfortunate event that someone should accidentally fall, the fall arrest equipment arrests the fall of the faller leaving the faller suspended at height close to the edge of the building or structure. The faller is secured within a harness that is then attached to lanyard or retractable line that is then attached to a secure anchorage. During the fall arrest process, the energy absorber located between the faller and the secure anchorage will normally deploy depending on the fall energy that needs to be absorbed thereby limiting the load on the faller's body. Whilst the faller is safely arrested and the load applied on the faller's body is limited, the physical demands placed on the human body during a fall event are nevertheless significant particularly if the faller is light in weight or is in a relatively poor state of health. However, there are further serious complications experienced by a faller suspended at height in a harness following the fall event. Motionless suspension in a harness for even a very short time, sets up a blood venous pooling effect, which becomes dangerous leading to unconsciousness and eventually death in as little as ten minutes. Various research studies have been carried out confirming the dangers of motionless suspension and there is now general agreement that it is vital to rescue and recover a faller as quickly as possible to avoid the onset of serious life threatening complications.

There are various methods currently used for rescuing fallers but none of these is generally satisfactory. The most common method is to call out the fire services. The speed of response depends on a number of factors such as where the fall has occurred and its distance from the nearest fire services depot, the availability of fire service resources at the time of the fall incident and whether the nearest fire services depot has the specialist equipment such as mobile platforms and lifting equipment for rescuing a person suspended at height. The specialist equipment tends to be relatively expensive and used less often than the standard firefighting equipment and is usually only available at a selection of fire service depots. All these factors make it difficult to predict how long the fire services will take between being alerted to a fall event and being in a position to begin to lower the suspended person to the ground. Generally, the response times vary widely between about 10 minutes at best and up to as much as an hour. A further problem can be to gain access to the specific location on the perimeter of a building where a fall has occurred. Many buildings are sited close to neighboring buildings or there are obstructions such as barriers all of which impede speedy access of the appropriate height rescue equipment to a fall location.

Another rescue method is for a rescuer equipped with descending apparatus to be lowered, or to lower himself, alongside the faller and to attach the faller's harness to the descending apparatus. The rescuer then cuts the faller's lanyard usually with a knife, so that the faller's weight is transferred to the descending apparatus. Having cut the faller's lanyard, the rescuer descends with the faller. This method has several disadvantages not least of which is the need for the rescuer to expose himself to significant risks. The rescuer will also need to have received substantial technical and physical training in order to carry out this rescue method. The training is generally expensive and so tends to be limited to a select few thereby increasing the possibility that a person properly qualified to carry out such a rescue procedure may not be immediately available at the time of a fall event.

A further rescue method is to attach the faller's harness to a lifting apparatus such as provided in GB2376009 and to lift the faller back to the top of the building or to the original location of the cable fall arrest system. This method presents a number of problems. Firstly, the harness attachment point of a person suspended at height after being arrested from a fall is likely to be two or more meters below the edge of the building. Any attempt to attach lifting cable to the attachment point from a position at the top of the building will typically compromise the safety of the rescuer. GB2376009 shows a substantial and convenient anchorage point in the form of an overhanging beam. In most typical locations where personnel work whilst attached to fall arrest systems or equipment there is unlikely to be a convenient and appropriate anchorage sufficiently elevated above both the faller and the edge of a building to enable the suspended faller to be lifted clear of the edge before being recovered to the level from which the fall occurred. The time needed to erect such a beam following a fall event would be significant. However, even if the faller were to be successfully raised and recovered, there is still the problem of transporting him or her easily and safely to the ground in order to enable him or her to access appropriate emergency services in the likely event that he or she has sustained injuries.

In either of the aforementioned rescue methods, not including the method using the fire services, there is a need to locate and transport the rescue system apparatus to the site where the fall has occurred and to unpack and prepare the apparatus before the rescue process can begin. Since the need to undertake a rescue is thankfully rare, there is considerable potential for problems that could cause further delays such as locating the rescue apparatus, ensuring that the package containing the apparatus is complete and that the rescue equipment is properly maintained. Also, as already mentioned, the rescue methods generally require a high level of personnel training and so there is the need to ensure that there is always an appropriately qualified rescuer at hand when height access work is being carried out.

Taking all the above factors into account there is considerable advantage in arranging the rescue apparatus to be an integral part of the faller's personal equipment so that the apparatus is immediately available at the site of the fall and ready to be operated on by the faller and/or a rescuer.

OBJECTS AND SUMMARY

Accordingly, one object of this invention is to provide a personal height rescue apparatus that is a part of the personal equipment associated with a person working at height so that, if the person should fall and be arrested by fall arrest equipment, the rescue apparatus is capable of withstanding dynamic fall arrest loading and is then ready for use after the fall has been arrested, to lower the person to the ground or other safe level. It is also an object of this invention that the personal height rescue apparatus should be lightweight and compact in order to have minimal impact on the mobility of personnel using the equipment and also for the personal height rescue apparatus to be economic to produce.

A further object of this invention is provide a personal height rescue apparatus that enables a person to be lowered to the ground or other safe level without delay after a fall has been arrested. The invention may be operated on by the faller equipped with the apparatus, albeit with provision for the apparatus to be operated by or in conjunction with another party such as a rescuer. Operation by a rescuer would be important if the faller were unconscious. Also, it may be necessary to be helped by one or more rescuers in order to avoid obstacles and to navigate with respect to wind effects during descent. Alternatively or additionally, the personal height rescue apparatus may be operated automatically after a person has been arrested from a fall, particularly if the person has sustained injury or is rendered unconscious during the fall. Injuries including head injuries can be common especially with fall arrest equipment that has significant elasticity such that the faller suffers a number of fall oscillations before coming to a standstill and where each oscillation adds to the potential for the faller to collide with surrounding objects.

According to the present invention there is provided a personal height rescue apparatus comprising a load element with means for attaching to one end of a safety line such as a lanyard or other type of safety line, the other end of such safety line being attached to a secure anchorage such as a building or other structure, and also comprising a harness attachment means for attaching to a safety harness that is worn by a person, and a connector with releasable means and means for releasing the releasable means whereby the connector is securely connected between the load element and the harness attachment means and, in the event that the person is arrested following a fall from height, the connector has at least sufficient strength to maintain its connection to both the load element and harness attachment means in order to withstand loads between the load element and harness attachment during the process of the person being arrested from the said fall, and further comprising a length of flexible elongate that is securely attached at one end to the load element and a part of its length is held in a store, and also comprising at least one speed control means that is disposed within the personal height rescue apparatus such that it controls the speed that the length of flexible elongate can move relative to the said harness attachment means, such that in the event that the person falls and the fall is arrested, the fall arrest loads between the load element and harness attachment means are sustained by the said connector with releasable means so that the person is then suspended at height, and subsequently, in order to lower the person to safety after the fall has been arrested, the means for operating the connector's releasable means is acted on such that the connector is released thereby releasing its connection between the load element and the harness attachment means so that the load between the load element and the harness attachment means is then transferred to the length of flexible elongate causing the flexible elongate to be deployed from the store at a speed relative to the harness attachment means that is controlled by the at least one speed control means, thereby lowering the person at a controlled speed of descent.

In most embodiments the personal height rescue apparatus has a casing that provides a convenient base for attaching and housing components. In typical embodiments both the harness attachment means and speed control means are attached to the casing so that the casing effectively provides the attachment between both these components. Also, a casing provides a convenient housing for storing the length of flexible elongate and for protecting it from the environment and possible accidental damage. A casing is also useful for storing the connector with releasable means together with part or all of the mechanisms that may comprise the means for releasing the connector.

Loads imparted between the load element and harness attachment means during the process of arresting a fall from height are typically significantly higher than the loads when lowering the person after being statically suspended following the fall arrest event. An energy absorber between the person and the secure anchorage limits the load on a person's body in fall arrest event. The magnitude of the required load limit varies between international jurisdictions. In Europe that maximum limit on the person's body is 6 kN whereas in the United States of America the limit is normally 4 kN. Therefore, applying a safety factor of two times, the connector with releasable means would need to be able to withstand loads across it of at least 12 kN. However, once the connector has been released, the tensile load in the flexible elongate will be substantially equivalent to the static weight of the man being lowered being typically around 1 kN. Therefore, applying a generous factor of safety of as much as 4 times to account for deceleration effects of any braking during descent, the flexible elongate and any speed control means for controlling the speed of deployment of the flexible elongate relative to the harness attachment means will only need to withstand tensile loading between the load element and the harness attachment means of up to 4 kN instead of a higher dynamic fall loading of up to 12 kN, so that the personal height rescue apparatus can be relatively compact and light in weight Whilst the use of a load element with releasable connector is advantageous for enabling both the flexible elongate and any speed control means for controlling the speed of deployment of flexible elongate to avoid dynamic fall arrest loading in a fall situation and therefore to be compact and light in weight, the invention may also include embodiments with a releasable arrangement that primarily prevents any speed control means from operating under such dynamic fall arrest loads. Such dynamic fall arrest loading may be prevented from being imparted to any speed control means by various methods such as applying a releasable stop or brake to the flexible elongate or to the means for deploying the flexible elongate, instead of using a releasable connector acting on a load element to which one of the flexible elongate is attached. For example, such an embodiment may comprise a length of flexible elongate whereby its first end is attached to a drum and a substantial part of its length is helically wound onto said drum and its second end is attached to a safety line or is attached directly to a secure anchorage, the drum being mounted on and free to rotate about a central axle, the central axle being securely attached to a structure that is securely attached to or may be integral with the harness attachment means, and further comprising a releasable stop or brake with release means for releasing the stop or brake such that the releasable stop or brake may act on the drum to prevent it from rotating until the stop or brake is released, and also comprising the at least one speed control means for controlling the speed that flexible elongate may be deployed relative to the harness attachment means, such that in the event that a person falls and the fall is arrested, the flexible elongate is prevented from deploying from the drum by the releasable stop or brake thereby also preventing dynamic fall arrest loading between the flexible elongate and the harness attachment means from being imparted to the at least one speed control means. After the fall has been arrested, the releasable stop or brake may be released by operating its release means such that the load between the flexible elongate and the harness attachment means is then transferred to the at least one speed control means thereby enabling deployment of flexible elongate from the drum in order to lower the person at a controlled speed of descent to the ground or other safe level. Operation of the release means to release the stop or brake may be similar to any of the preceding and subsequent embodiments associated with a releasable connector including manual, automatic and remote release. The disadvantage however with applying a stop or brake to the flexible elongate or to the means for deploying flexible elongate from its store is that dynamic fall loads may be imparted to at least part of the length of flexible elongate and, in an embodiment such as that using a drum for the store, dynamic fall loads are also imparted to the drum, its axle and the structure connecting the axle to the harness attachment means resulting in these components needing to be relatively substantial and therefore likely to be heavier and less compact than using a load element with releasable connector where dynamic loading is only imparted between the load element and the harness attachment means and is not imparted to the flexible elongate. The size and weight of the flexible elongate may be optimized by arranging for the part of the flexible elongate that is subjected to the higher dynamic fall loads to have a proportionately higher cross sectional area or to consist of more than one parallel length of flexible elongate.

In any or all embodiments of the personal height rescue apparatus the invention could include the above mentioned energy absorber that limits load on the person's body whilst being arrested from a fall and where the load limitation is required to be less than 6 kN in Europe and less than 4 kN in the United States of America. Typically, the energy absorber would be incorporated in either the connector between the load element and the harness attachment means or between the load element and the connector or between the harness attachment means and the connector.

Operation of the means for releasing the connector may be achieved by manual operation, ideally by the person being lowered after a fall. In many situations, the personal rescue apparatus will be located behind the faller's head during suspension after a fall so that the release control means are extended to reach a convenient location for operation by the faller. A typical means of operation is provided by a pull cord linked to an appropriate mechanism for activating the release of the connector. It is common for regulatory authorities to require the release of a connector in a safety critical situation, where the release could be activated accidentally, to have two or more distinct actions in order to complete the release function. Therefore, whilst the release means could be operated with a single operator action such as pulling a cord once, various other release operation embodiments are possible that provide more than one distinct action. A simple manual release operation embodiment could be to provide one pull cord requiring only one pull action to release the connector but where the cord is accessed by opening a pouch such that opening the pouch and pulling the pull cord are then two distinct actions. A further release operation arrangement could utilize two or more pull cords that need to be pulled together, sequentially or sequentially but in a prescribed order of sequence in order to release the connector. Another release operation arrangement may be to use only one pull cord that is pulled a prescribed number of times before releasing the connector. Other safety measures can be applied that only allow successful operation of the means to release the connector when a person is suspended after being arrested from a fall rather than during or before the fall event. Again, many different embodiments are possible. For example, the release mechanism may only be operable within a predetermined range of magnitudes of load between the load element and the harness attachment means, in order to be only releasable when loads equate to the weight of a person suspended. Another embodiment may have a release mechanism that is only releasable when a substantially static load between the load element and the harness attachment means has been sustained for a predetermined duration of time or where such substantially static load equates to the weight of a person suspended and has been sustained for a predetermined duration of time.

If the faller is unable to operate the connector release means due to injury or unconsciousness as a result of a fall event, the personal height rescue apparatus may include one or more facilities for enabling the connector to be release by a rescuer or helper. This may be achieved by using an additional releasing means that extends to the ground or some other safe level after a person is arrested from a fall, or, by attaching extensions to the faller's own manual release means that can then be operated by a rescuer of helper or, by using a device such as a pole with a hook at one end whereby the hook can be used to activated a releasing means, or, by any other suitable means. A further alternative is for a rescuer equipped with a personal rescue apparatus to lower himself or herself alongside the unconscious faller and to operate the faller's manual release means on behalf of the faller.

In some embodiments, it may be beneficial to operate the connector releasing means automatically particularly if the person suspended after an arrested fall has sustained injury to the head and has become unconscious. It is generally important to ensure that automatic release of the connector cannot occur until the process of arresting a fall from height is complete in order to avoid the possibility of relatively high dynamic loads during such a fall being transmitted to the length of flexible elongate and the at least one speed control means. Embodiments with automatic release means for releasing the connector may include a release means that releases the connector automatically in response to a load applied between the load element and the harness attachment and where such a load has a magnitude within an upper and lower limit typically relating to the weights of the heaviest and lightest users respectively of the personal height rescue apparatus. Also, such an automatic release means may include a means for delaying release of the connector for a short period such as 30 seconds after the initial sensing of load between the said upper and lower load limits, in order to ensure that activation occurs after the fall event is completed. Many falls include not only the initial fall but also subsequent dynamic motion usually due to elasticity in a fall arrest system causing a faller to bounce before coming to a standstill and so it is important to ensure that the connector is only released when or after dynamic motion in the vertical plane has substantially ceased. As a further safeguard against the release means being activated accidentally the release means to release the connector may be arranged such that the release means cannot be activated until loads within the said upper and lower limits of magnitude between the load element and harness attachment means have been sustained within such limits of magnitude for a specified period of time such as 30 seconds. Typically, if the time period that loads are sustained, within the specified upper and lower limits of magnitude, is less than the specified time period such as 30 seconds, then the activation process would cease as if load between the load element and the harness attachment means had not been applied. In other embodiments, the activation process would cease as if no load had been applied if such loads reduce below a specified lower limit. However, if such loads increase beyond a specified upper limit then the activation process may be halted and subsequently resumed if and when such loads fall below the specified upper limit. Such an automatic release means may be achieved mechanically using a mechanical device for providing a specified time delay.

A more sophisticated automatic release means for releasing the connector may be achieved using typically standard electronic components to electrically activate an actuator that then releases the connector. Such an actuator may be an electrical motor, solenoid, pyrotechnic device or any other suitable type of actuator. Pyrotechnic actuators are widely used in the automobile industry for activating safety air bags and to pretension seat belts and have an excellent record for long-term reliability in a wide variety of environments. They also have the advantages of being detonated by a relatively small electrical current whilst producing high levels of mechanical energy after detonation that is then available to release the connector. A potential problem with relying on electrical power in a safety critical device is to ensure that there is sufficient electrical power available when it is needed. Electrical power is typically drawn from a battery or other suitable portable store of electrical power incorporated with the personal height rescue apparatus. In order to minimize electrical power use, the electronic circuit including the battery may be arranged such that it remains open without any power being drawn on the battery until there is a load applied between the load element and the harness attachment means as would occur when a person is suspended after a fall arrest event. The magnitude of the load would typically be greater than a specified lower limit in order to minimize the possibility of the circuit being closed inadvertently. The magnitude of the lower limit may usefully be related to the weight of the lightest user of the personal height rescue apparatus. When the load between the load element and the harness attachment means is above the specified lower limit, the electronic circuit would then be closed such that electrical power from the battery is available to activate the actuator. In order to ensure that the electrically activated actuator only releases the connector after a fall event has been completed and the faller is substantially motionless, a standard electronic timer could be used to provide a predetermined time delay such as 30 seconds between the electronic circuit being closed and the actuator being activated to release the connector such that if the load between the load element and the harness attachment means were removed or its magnitude were below the said lower limit, then the electronic circuit would be opened and the activation process would cease as if the load had not been applied. In some workplace applications, relatively high loads may be applied between the load element and the harness attachment means when a worker may use his harness, lanyard and secure anchorage to restrain his position whilst working particularly on a steeply inclined surface. A relatively heavy worker may apply restraint loads between the load element and the harness attachment means that could exceed the said lower limit of load magnitude and therefore activate the electronic circuit. Whilst this situation is unlikely, the electronic circuit may incorporate a sensor that senses the load between the load element and the harness attachment means or senses acceleration forces of the personal height rescue apparatus during a dynamic fall event such that the connector is only released after a relatively high threshold limit of load magnitude has been surpassed. This would effectively ensure that the connector is only released after a relatively severe fall event where a faller might sustain injury or be rendered unconscious. Such a personal height rescue device would have a manual release means in order to enable the faller, in a less severe fall event, to operate his own manual release. The manual release means may be a simple electrical switch to activate the electrical actuator or it could be a mechanical arrangement or any other suitable arrangement. Means for sensing loads above the relatively high threshold limit may also be provided mechanically.

In any embodiments whereby the release means for releasing the releasable connector or releasable stop or brake is operated automatically or where the operation is manual by means of an extended pull cord, the personal height rescue apparatus may be located at any position between a person wearing a harness and the secure anchorage on a structure or building to which the person is attached because there is no requirement for the personal height rescue apparatus to be in close proximity to such a person. For example, the personal height rescue apparatus may be attached directly to a secure anchorage rather than to the person's harness so that the secure anchorage bears the weight of personal height rescue apparatus. In such an embodiment where the personal height rescue apparatus is attached directly to a secure anchorage it may be preferable for the harness attachment means, that would otherwise be attached to the harness, to be attached to the anchorage and for the load element and/or flexible elongate to be attached to the safety line disposed between the person's harness and the secure anchorage so that only flexible elongate moves away from the secure anchorage when the flexible elongate is deployed thereby reducing the possibility of deployment being compromised by obstacles in the descent path.

In any of the preceding or subsequent embodiments using electrical energy, further back up release means could be provided mechanically in case the electrical release means should fail for any reason.

A useful addition to any of the preceding or subsequent arrangements using electrical energy may be the inclusion of an electronic sounder that could be activated to give an audible warning that a person has fallen. Such a sounder could also be useful for indicating that power is being drawn from the battery. An electrically operated sounder could also be added to any preceding or subsequent mechanical arrangements but where such a sounder is energized by a source of electrical energy such as a battery. Alternatively, a sounder could be provided mechanically in a variety of arrangements including adapting the at least one speed control mechanism such that its operation is clearly audible as a warning that someone is descending after a fall arrest event.

An alternative embodiment of this invention using typically standard electronic components is to enable release of the connector to be carried out remotely by a rescuer or helper. In an injurious fall event where the faller requires medical attention it can be desirable that a rescuer or helper activates the faller's release means and is then ready to receive and administer assistance when the faller reaches the ground. An embodiment of the invention is therefore for a rescuer or helper to be equipped with a typically standard wireless sender so that the rescuer or helper can send a wireless signal to a wireless receiver incorporated in the faller's personal height rescue apparatus such that the signal can initiate electrical activation of an actuator such as an electric motor, solenoid, pyrotechnic device or some other suitable actuator in order to release the connector. As before, the electrical power may be provided by a battery or some other suitable electrical power store and, in order to minimize electrical power use, the electronic circuit including the battery may be arranged such that it remains open without any power being drawn on the battery until there is a predetermined threshold of load applied between the load element and the harness attachment means as would occur in the event of someone being suspended after a fall. A time delay device may also be included to ensure that the connector is not released until after the fall event is substantially complete. The faller may also be equipped with a wireless sender in order to activate his own release means if he is not injured or unconscious after a fall. This could be advantageous if, in another situation, roles reversed and the faller became the rescuer and he could then utilize his own wireless sender to perform a remote rescue. Alternatively, the faller could activate his own release means with a simple manually operated electrical switch connected directly to the electronic circuit in his personal height rescue apparatus or activate his release mechanism with some other suitable release means such as a mechanical release means that is independent of any electronic circuit.

In typical embodiments, this invention has a speed control means that automatically controls and limits the speed of descent of a person. However other embodiments may also have a further speed control means that can be operated manually by the person being descended in order to reduce the speed of descent and may also have the means to stop their descent if required. This further speed control means may have the ability to be operated on by a rescuer in addition to or instead of being operated on by the person being descended. Operation by a rescuer would be useful in the event that the person being descended were unconscious. Both automatic and manual speed control means are normally in close proximity for convenience. In practice, it has been found that pulling or releasing one or more control lines is an appropriate method of operating the manual speed control means. However, it is debatable as to whether speed should be reduced by the action of pulling or releasing the one or more control lines. Pulling is a conscious action and is therefore often best associated with reducing speed particularly if the person is unconscious in which case it is vital to lower the person to safety as quickly as possible. For convenience and to minimize potential for confusion, operation of the manual speed control means is often, but not necessarily, shared with operation of the releasing means for releasing the connector. In a further typical embodiment of a manual speed control there is provided a means for manually operating a speed control means to stop the deployment of flexible elongate at any stage in the descent process and to remain stationary without needing any sustained or further operation of the manual speed control means after having stopped. This is useful in a situation where a rescuer equipped with the personal height rescue apparatus needs to lower himself alongside a person who is unconscious and suspended after having been arrested from a fall and who is also equipped with a person height rescue apparatus, and where the rescuer needs to remain stationary alongside the faller and to have both hands and any other faculties available free in order to release the faller's connector release means. The manual speed control having stopped deployment of the flexible elongate can then be operated on at an appropriate time to release the braking mechanism and resume deployment of the flexible elongate from the store.

However, in sophisticated embodiments, actuation of the braking means could be arranged electrically as has already been referred to with respect to electrical actuation of the connector releasing means. As with electrical actuation of the connector releasing means, electrical actuation of the manual speed control means could be controlled by sending signals wirelessly from a controller located with the person descending and/or with a rescuer.

BRIEF DESCRIPTION OF THE DRAWINGS

The invention will now be described by way of example only with references to the accompanying diagrammatic figures, in which.

DETAILED DESCRIPTION

Figure 1:
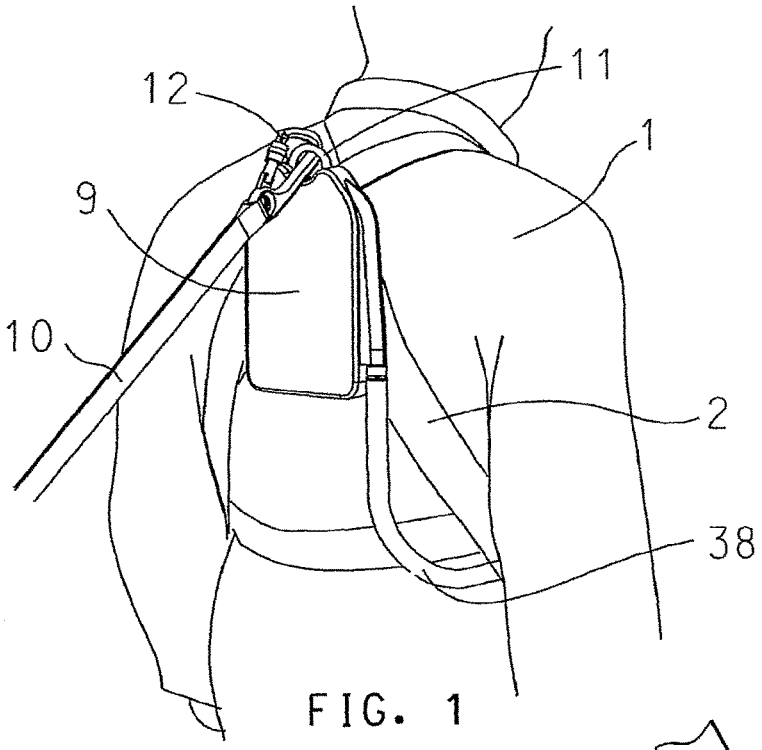
FIG. 1 shows a personal height rescue apparatus according to a first embodiment of the invention worn by a person.
Figure 2:
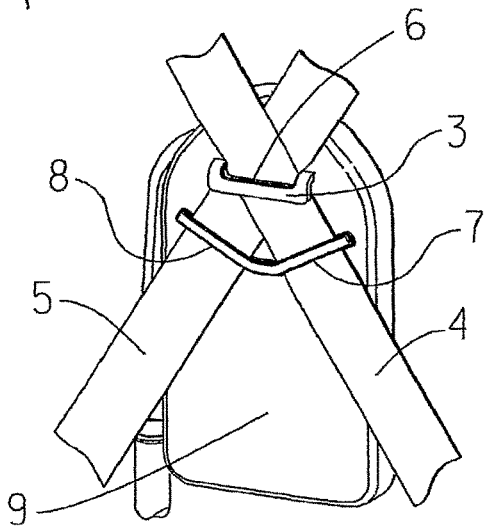
FIG. 2 shows a reverse view of the embodiment in FIG. 1 rotated about a vertical axis.

In FIG. 1, the first embodiment of the personal height rescue apparatus is shown as worn on the back of person 1 whilst carrying out ordinary work duties at height. Person 1 wears a harness 2 that is securely attached to bracket 3 in FIG. 2 by means of straps 4 and 5 of harness 2 being passed through aperture 6 in bracket 3. Straps 4 and 5 are also passed through guides 7 and 8 that are part of or are attached to the personal height rescue apparatus housing 9 in order to hold the personal height rescue apparatus in position on harness 2. In FIG. 1, lanyard 10 is shown attached at one end to a load element, such as eye 11, by means of a typical attachment device shown as karabiner 12 whilst the other end of lanyard 10 is attached to a secure anchorage provided by a fall arrest system or single point anchorage. The load element eye 11 and bracket 3 are strong components connected together so that any load imparted on lanyard 10 is transferred across the connection between eye 11 and bracket 3 to harness 2. In the event that person 1 should fall, the severity of his fall and the resulting load imparted on his body would largely depend on his weight and the distance through which he falls before being arrested between the fall arrest anchorage and his harness 2. However, regulatory authorities recognize the limitations of load that the human body can sustain before causing serious injury and therefore require that persons working at height should be equipped with an energy absorber between the harness and fall arrest anchorage that limits load on the harness irrespective of the severity of a fall. Such an energy absorber is typically integrated into lanyard 10 or a further device commonly known as a fall arrester that is attached between the harness and the fall arrest anchorage and absorbs energy by means of friction. The load limits required by regulatory authorities vary internationally. In Europe, the load on the harness is limited below 6 kN whereas, in the United States of America the load on the harness is limited below 4 kN. Regulatory authorities also generally require that safety equipment components should be designed to perform with a factor of safety of at least two times the maximum predicted load. Therefore both eye 11 and bracket 3 and the connection between them need to sustain a load of at least 12 kN in the event of a person being arrested after a fall.

Figure 3:
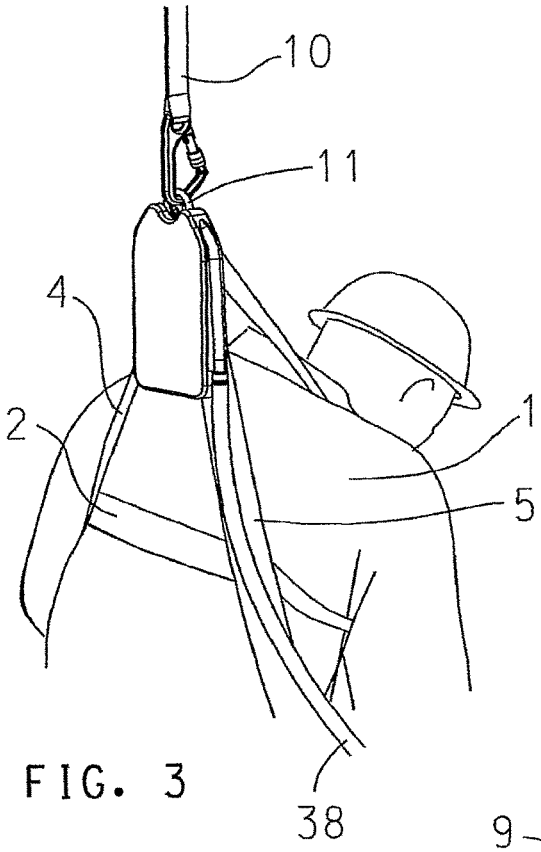
FIG. 3 shows the height rescue apparatus of FIG. 1 in a fall arrest configuration worn by a person suspended after being arrested following a fall.

FIG. 3 shows person 1 equipped with the first embodiment of the personal height rescue apparatus in a typical posture after having been arrested following a fall. The combination of person 1's body tending to slump towards the parts of harness 2 supporting his body together with the tendency for harness 2 to undergo some stretch particularly during the preceding fall event, both result in straps 4 and 5 becoming realigned around bracket 3 such that load generated as a result of and after a fall event is sustained by bracket 3. Load on bracket 3 is transferred across its connection with eye 11 through to lanyard 10 and then to the secure fall arrest system or single point anchorage. The personal height rescue apparatus is therefore able to withstand fall arrest, loading between the harness 2 and bracket 3, between bracket 3 and eye 11 and between eye 11 and lanyard 10.

Figure 4:
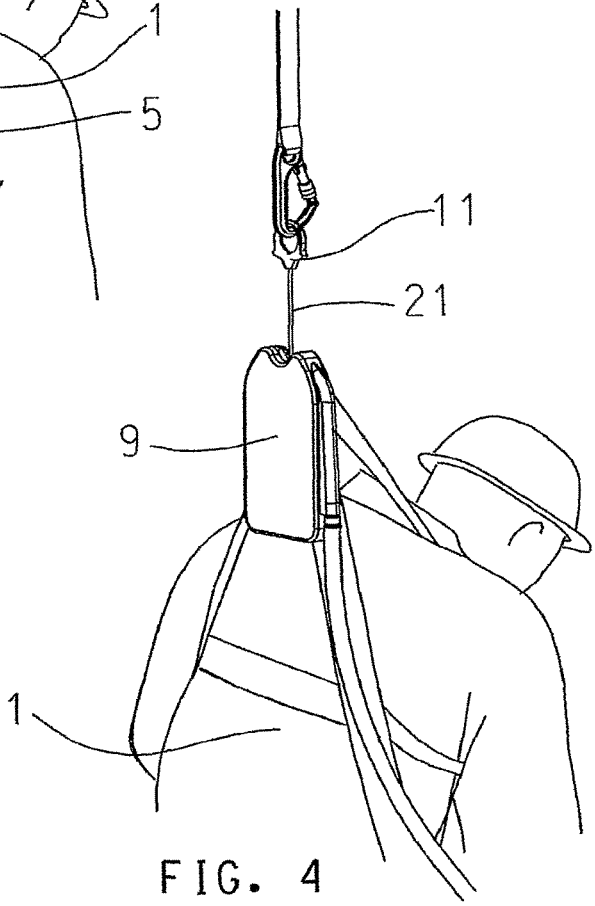
FIG. 4 shows the view in FIG. 3 but with the height rescue apparatus of in a lower configuration with a connector having been released and the person in the early stage of descent.

When person 1 has come to rest after being arrested following a fall and is suspended at height applying a substantially static loading across bracket 3 and eye 11 equivalent to person 1's weight, the personal height rescue apparatus is now ready to be deployed to lower the person to the ground or other safe level. Deployment is typically initiated by releasing a first connection between eye 11 and bracket 3 that sustains load during the fall arrest phase of a fall event and replacing the connection between eye 11 and bracket 3 with a second connection including flexible elongate that can be deployed to lower the person. FIG. 4 shows person 1 having actuated the release of the connection between eye 11 and bracket 3 so that the connection is transferred to flexible elongate 21 allowing eye 11 to move away from casing 9 and therefore bracket 3 to which harness 2 is attached.

Figure 5A:
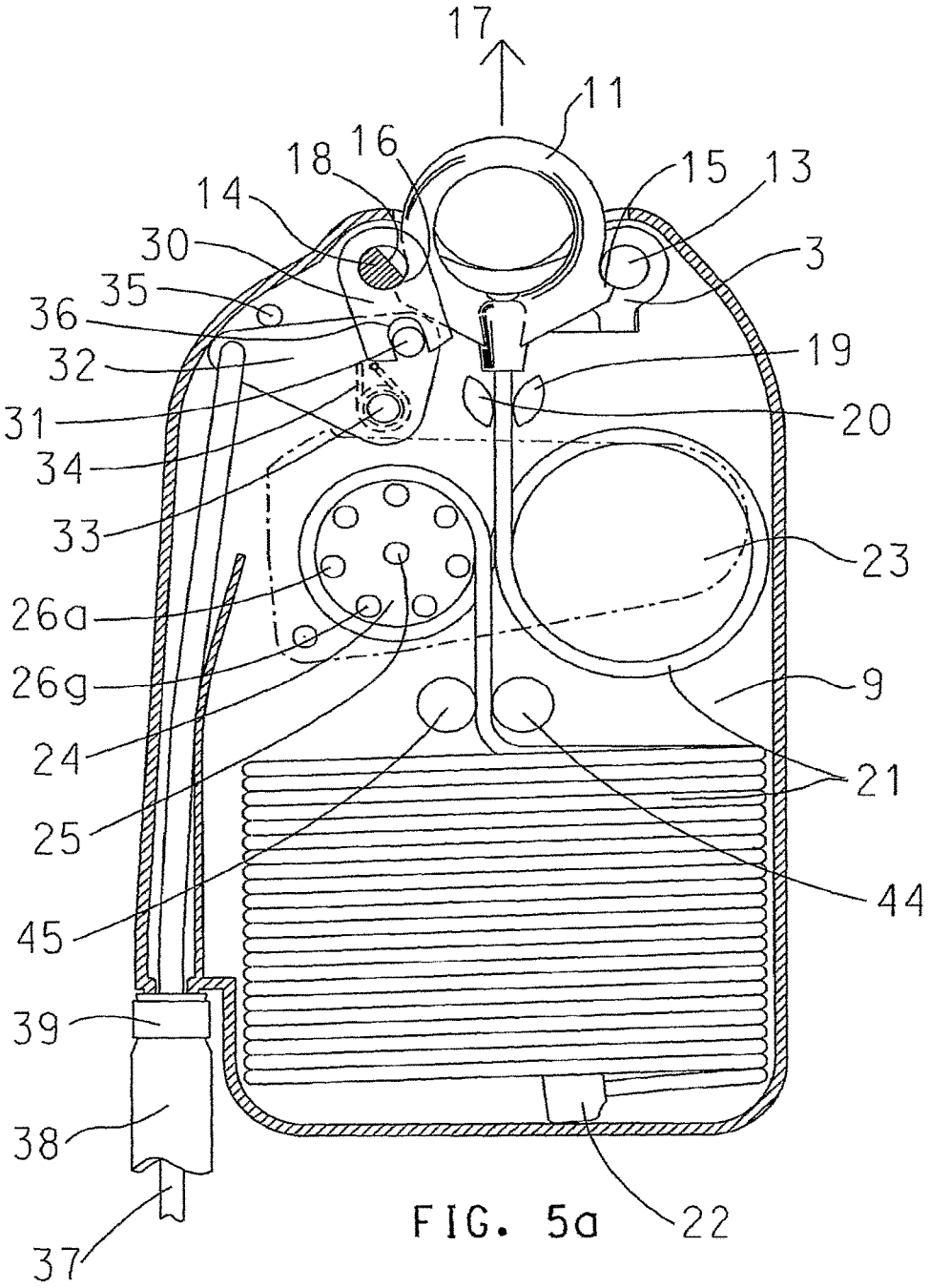
FIG. 5*a* shows a partially cut away view of the embodiment in FIG. 1 in the fall arrest configuration.

FIGS. 5*a* through to 9*a* show the first embodiment in greater detail and with alternative means for actuating the release of the connection between eye 11 and bracket 3. FIG. 5*a* illustrates the height safety apparatus in a fall arrest configuration with FIGS. 5*c* and 5*d* illustrating the height safety apparatus in a lower configuration.

Figure 5B:
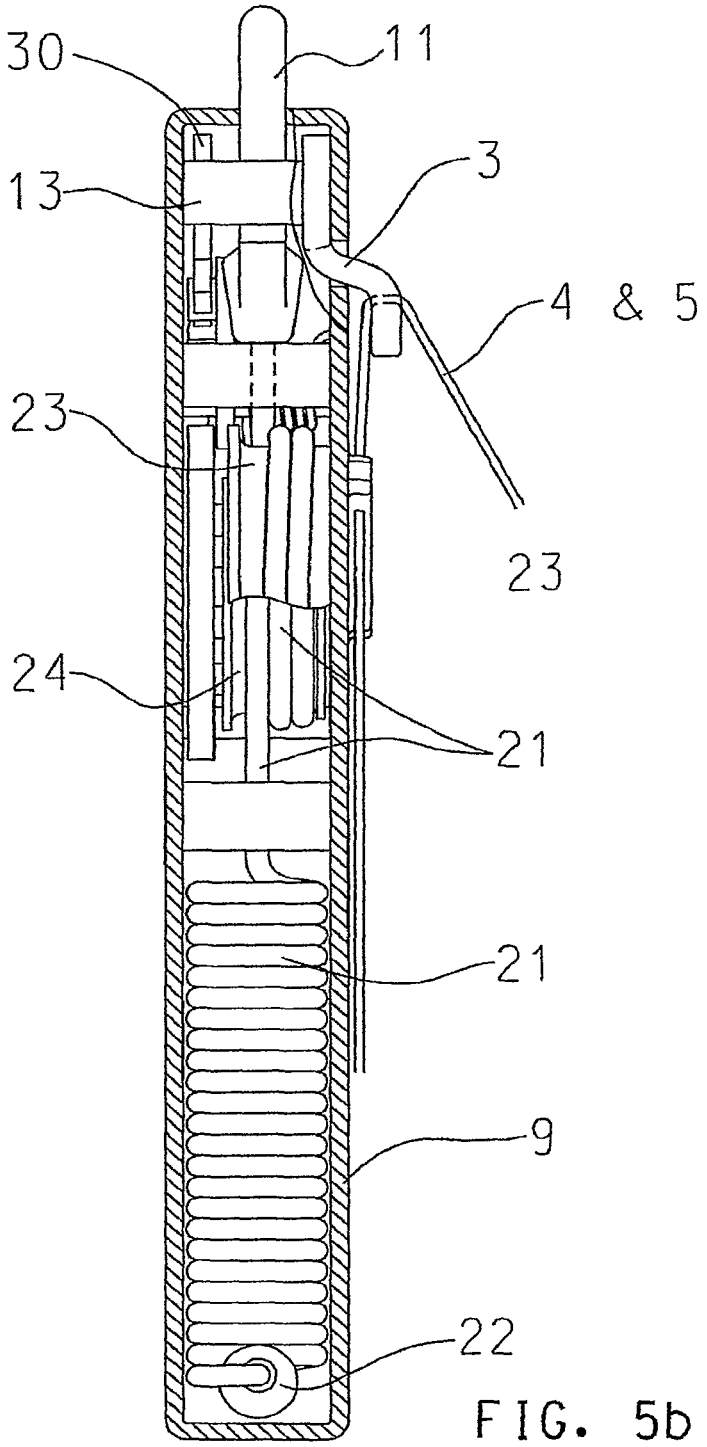
FIG. 5*b* shows an elevation partially cut away of FIG. 5*a;*
Figure 5C:
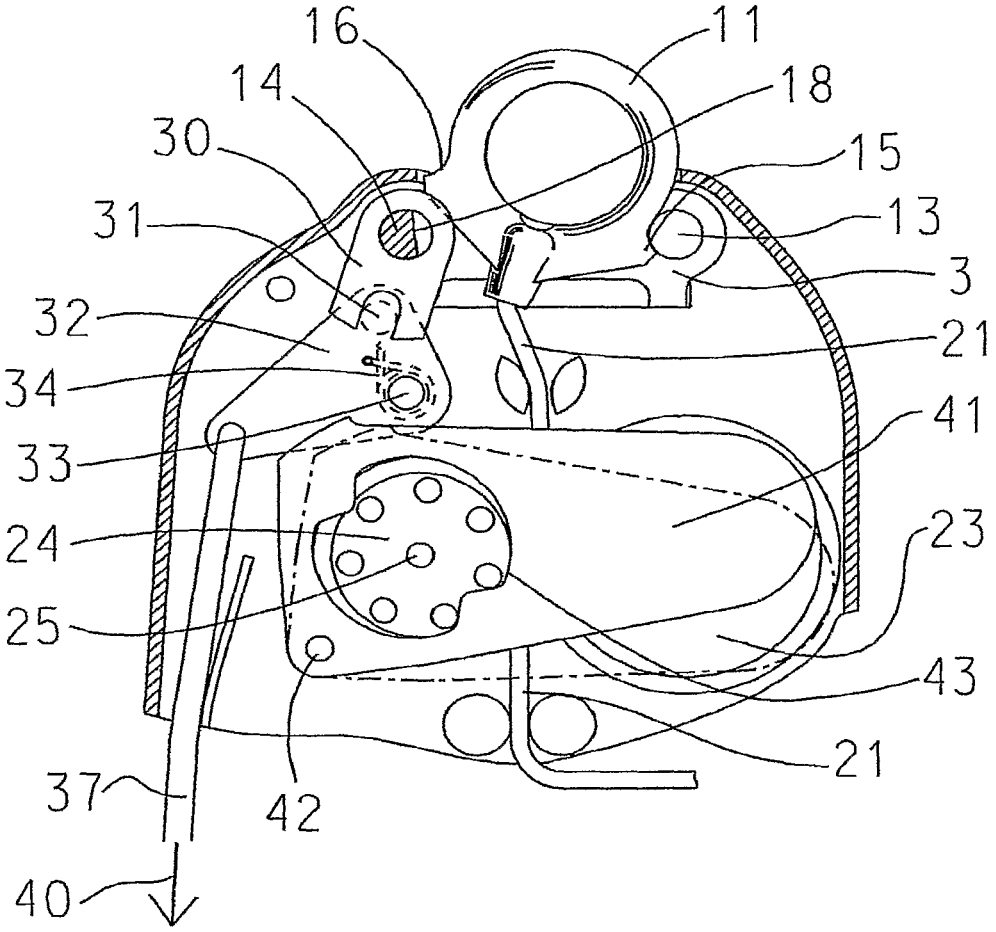
FIG. 5*c* shows a partially cut away view of FIG. 5*a* in a first level of operation in the lowering configuration.
Figure 5D:
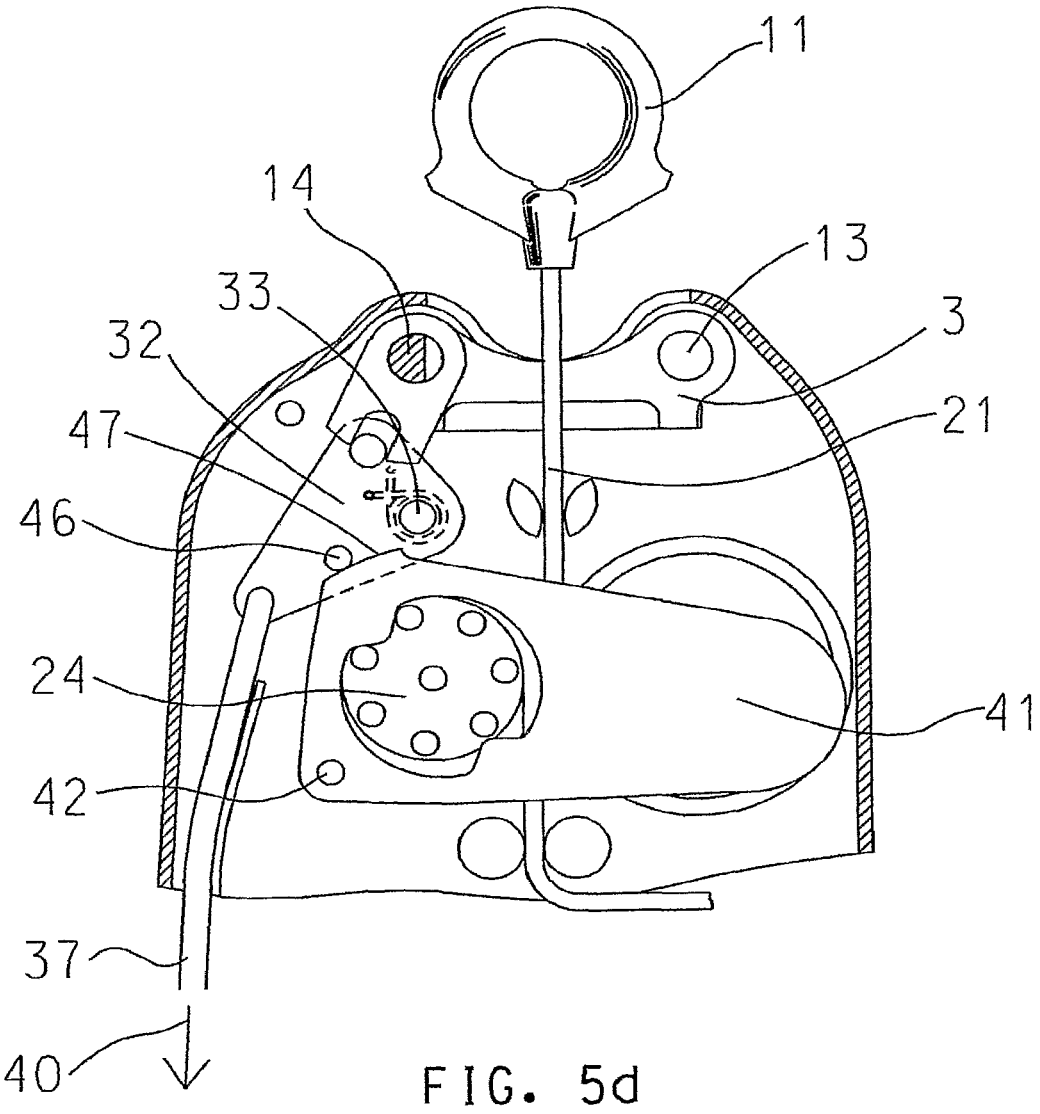
FIG. 5*d* shows a partially cut away view of FIG. 5*a* in a second level of operation in the lower configuration.

In FIGS. 5*a* and 5*b* pins 13 and 14 are cylindrical shafts with axes perpendicular to, and both pins being, supported between parallel plates that are part of casing 9. Both pins 13 and 14 are also located in bracket 3 so that bracket 3 is securely attached to both pins 13 and 14. Bracket 3 may also be securely attached to casing 9. However, pin 14 differs from pin 13 in that pin 14 has a flat portion 18 and is also able to rotate with respect to casing 9 such that flat portion 18 is also able to rotate about the axis of pin 14 with respect to casing 9. Eye 11 has abutments 15 and 16 that each bear on pins 13 and 14 respectively such that eye 11 cannot move in the direction of arrow 17 when flat portion 18 is in the radial attitude as shown in FIG. 5*a*.

Lever 30 is rigidly attached to pin 14 such that rotation of lever 30 also results in rotation of pin 14. Lever 32 is in the same plane as lever 30 and is able to rotate about axle 33 and has torsion spring 34 that tends to urge rotation in a clockwise direction relative to FIG. 5*a* such that lever 32 is normally abutted against stop pin 35 in its static position. Levers 30 and 32 are linked by means of pin 31 that is rigidly attached to lever 32 and which is also constrained within slot 36 on lever 30 such that radial movement of pin 36 about axle 33 will result in radial movement of both lever 30 and also pin 14 with respect to casing 9. Pull cord 37 is a length of flexible elongate attached at one end to lever 32 and with its other end being located in a convenient position on person 1's harness. Pull cord 37 is shown as being enclosed in sheath 38. Sheath 38 is typically a tubular sheath that protects pull cord 37 and is strong in tension in order to prevent pull cord 37 from being pulled accidentally such as during a fall arrest event. Clip 39 securely attaches sheath 38 to casing 9. In FIG. 5*c*, pull cord 37 is shown as having been pulled substantially in the direction of arrow 40 thereby rotating lever 32 in an anticlockwise direction about axle 33 causing lever 30 to rotate with pin 14 in a clockwise direction about pin 14 relative to casing 9 such that flat portion 18 also rotates in a clockwise direction. When flat portion 18 has reached the degree of rotation as indicated in FIG. 5*c*, abutment 16 of eye 11 is able to rotate free of pin 14 about abutment 15 bearing on pin 13. In FIG. 5*d*, eye 11 is shown as having disconnected from both pins 13 and 14.

In order to avoid the possibility of accidental release other than following suspension after being arrested from a fall, it is common to require two distinct actions in order to complete actuation of the release mechanism. In its simplest form, this may be achieved by requiring person 1 to access a pouch possibly secured with a temporary fastening method such as Velcro before pulling on pull cord 37 to activate release.

On releasing eye 11 in order to lower person 1 after being suspended following a fall being arrested, the weight of person 1 is then transferred to flexible elongate 21. In FIG. 5*a*, flexible elongate 21 is a length of flexible elongate that is securely attached at one end to eye 11 and at its other end it is attached to end stop 22. From its attachment to eye 11, flexible elongate 21 is passed through two guides 19 and 20 and is then helically wound in an anticlockwise direction relative to FIG. 5*a* around cylinder 23 and cylinder 23 is rigidly attached to casing 9. Cylinder 23 reduces tensile loading on flexible elongate 21 between the point at which the flexible elongate is wound onto cylinder 23 from eye 11 and the point at which it leaves cylinder 23. This is substantially as a result of radial friction between the surface, of flexible elongate 21 and the radial surface of cylinder 23. FIG. 5*a* shows flexible elongate having been wound through approximately two revolutions around cylinder 23. However, the number of wound revolutions will depend on the coefficient of friction between the surfaces of flexible elongate 21 and cylinder 23. On leaving cylinder 23, flexible elongate 21 is helically wound in a clock wise direction relative to FIG. 5*a* around drum 24 and drum 24 is able to rotate about axle 25 and axle 25 is secured to casing 9. On one axial end of drum 24 there are six pins shown including pin 26*a* and pin 26*g* protruding from the surface of drum 24 whereby all six pins are radially equi-spaced about axle 25. In FIG. 5*c*, speed control lever 41 is a weighted lever that can pivot about axle 42 and has a profiled aperture 43 through which the six pins including pins 26*a* and 26*g* protrude from the surface of drum 24. When eye 11 is released and the weight of person 1 is transferred to flexible elongate 21, flexible elongate slips around cylinder 23 and rotates with drum 24 about axle 25. The tension in flexible elongate 21, substantially equivalent to the weight of person 1, is reduced as already mentioned as flexible elongate leaves cylinder 23 and is passed around drum 24. As drum 24 rotates with flexible elongate 21, speed control lever 41 is forced to move in opposite radial directions with an arc defined by the juxtaposition of aperture 43 with the six pins including 26*a* and 26*g*. Since the rotation of drum 24 generates movement of speed control lever 41 about axle 42, there will be a limit whereby inertial resistance caused by the movement of speed control lever 41 will resist and therefore reduce or limit the speed of rotation of drum 24 and thereby limit the speed that flexible elongate is deployed from drum 24. The use of cylinder 23 in order to reduce tensile load on flexible elongate 21 enables speed control lever 41 to be relatively compact. Whilst speed control lever 41 is shown as one means for limiting speed of deployment of flexible elongate 21 from drum 24, any other suitable means for controlling speed could be used.

Moving from drum 24 away from eye 11, flexible elongate 21 is passed between guides 44 and 45 before being packaged in a store area as shown in FIG. 5*a*. Typically, 44 and 45 are arranged such that they bear slightly on flexible elongate 21 to provide some tension between flexible elongate 21 leaving the store area and being wound onto drum 24. At the stored end of flexible elongate 21 there is an end stop 22 that is securely attached to the end of flexible elongate 21 such that in the event of the store being depleted whilst lowering person 1, end stop 22 would become trapped between guides 44 and 45 and thereby prevent flexible elongate 21 from leaving casing 9.

Flexible elongate 21 may be a modern high strength polymer rope. In practice, it needs to withstand a substantially static tensile loading equivalent to the weight of person 1 being typically around 1 kN. However, applying a generous factor of safety of about 4 times this could be increased to at least 4 kN. Various high strength fiber ropes are widely used and it is common for rope with a cross sectional diameter of as little as 4 mm to have a breaking load of as much as 18 kN. Therefore, flexible elongate 21 could be such a high strength rope so that it can be stored compactly with sufficient length to lower a suspended person safely whilst also being lightweight. Compactness and lightweight are important factors bearing in mind that the personal height rescue apparatus is worn by personnel at all times whilst working at height. However, flexible elongate 21 may be any other suitable material including steel cable or wire or polymer tape or webbing.

In FIG. 5*d*, lever 32 has a protruding pin 46 such that when lever 32 is rotated about axle 33 in an anticlockwise direction relative to FIG. 5*d*, pin 46 bears on surface 47 of speed control lever 41 thereby limiting the radial scope of movement of speed control lever 41 about axle 42 and resisting the rotation of drum 24. Therefore, whilst pull cord 37 when pulled substantially in the direction of arrow 40 to a first level releases eye 11 allowing eye 11 to move away from casing 9 as flexible elongate 21 is deployed, pull cord 37 can also be pulled to a second level that resists or stops radial movement of speed control lever 41 thereby slowing and, if necessary stopping, the descent of person 1. In some embodiments, both the aforementioned first and second levels to which pull cord 37 is operated could be the same such that the brake is applied at the same time as the connector is released.

Figure 6A:
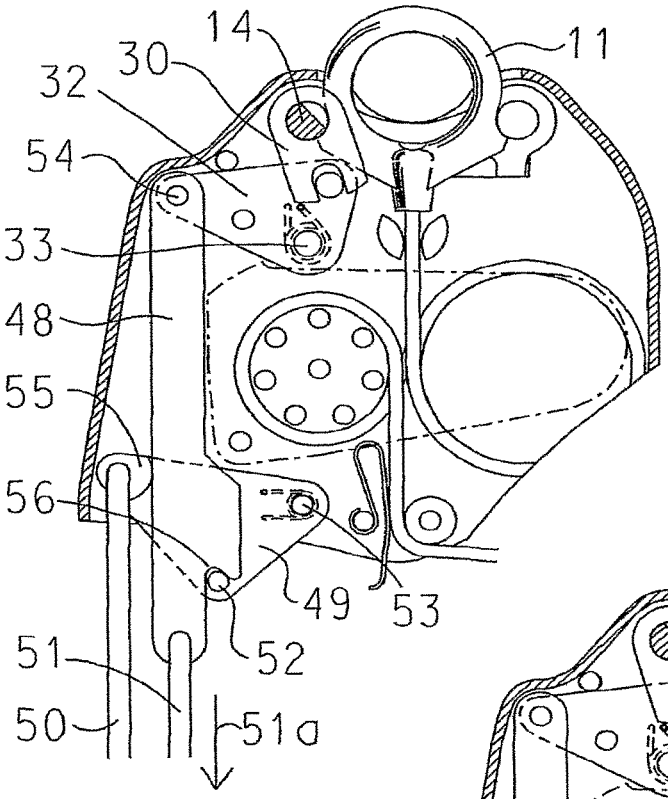
FIG. 6*a* shows a partially cut away view of FIG. 5*a* with a first alternative connector release mechanism.
Figure 6B:
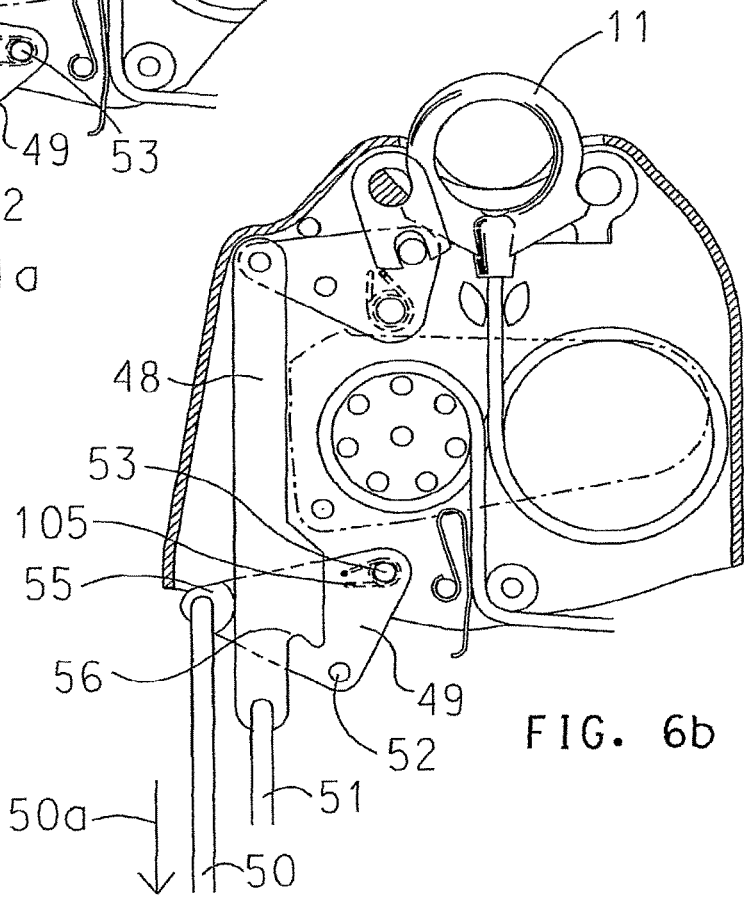
FIG. 6*b* shows FIG. 6*a* in a first level of operation.
Figure 6C:
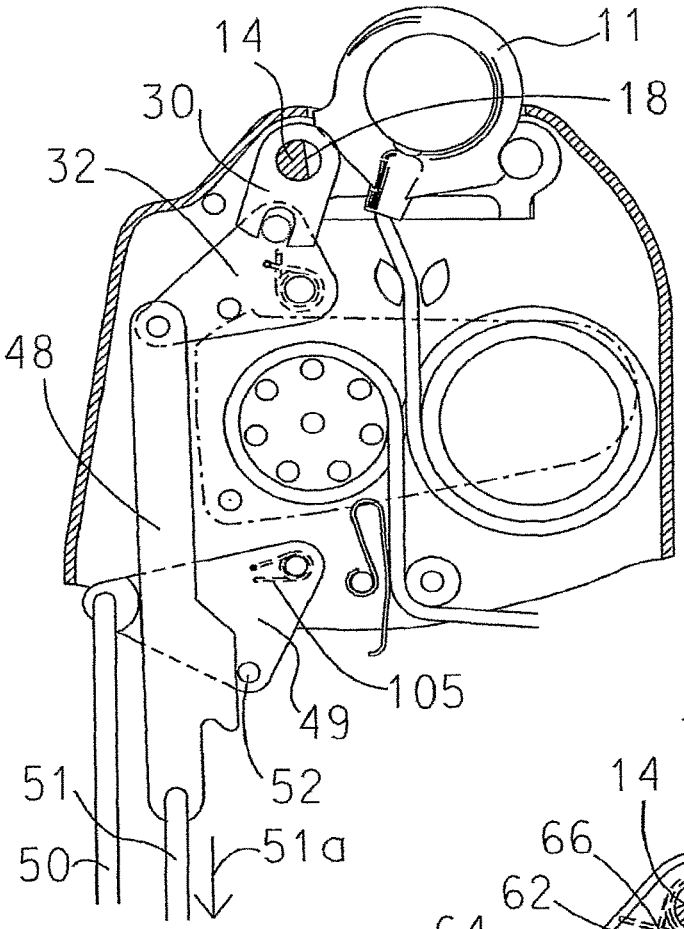
FIG. 6*c* shows FIG. 6*a* in a second level of operation.

FIGS. 6*a* through to 6*c* show a first alternative arrangement for releasing eye 11 whereby pull cords 50 and 51 are required to be pulled in a specific sequence with pull cord 50 preceding pull cord 51. This is to reduce further the possibility of accidentally releasing the mechanism prematurely. In FIG. 6*a*, lever 48 is attached to lever 32 such that it can rotate relative to lever 48 about axle 54. Lever 49 is able to rotate about axle 53 and has a protruding pin 52 that is rigidly fixed to its surface and which bears on surface 56 of lever 49. Also, lever 49 has abutment 55 that bears on lever 48. Therefore, if pull cord 51 is pulled substantially in the direction of arrow 51*a*, lever 48 is prevented from moving due to protruding pin 52 bearing on surface 56 of lever 48. This also applies if both pull cord 50 and 51 are pulled concurrently substantially in the direction of arrow 51*a*. However, if pull cord 50 is pulled first, as shown in FIG. 6*b*, substantially in the direction of arrow 50*a*, lever 49 rotates about axle 53 allowing protruding pin 52 to move away from surface 56 on lever 48 such that lever 48 may then be moved by pulling pull cord 51 substantially in the direction of arrow 51*a*, as shown in FIG. 6*c* thereby rotating lever 30 and releasing eye 11. The addition of torsion spring 105 at axle 53 tending to rotate lever 49 in a clockwise direction relative to FIG. 6*b*, will only allow pull cord 51 to be pulled both after and whilst pull cord 50 is pulled to its extent.

Figure 7A:
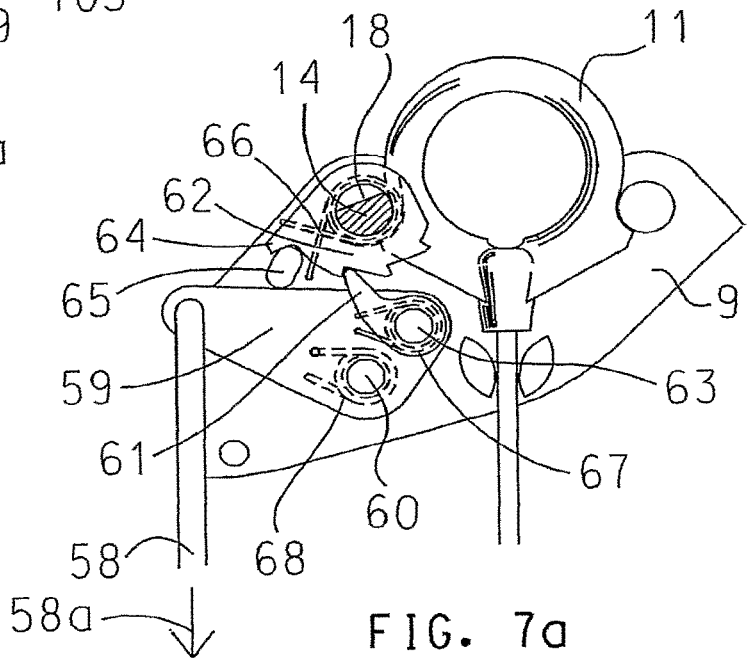
FIG. 7*a* shows a partially cut away view of FIG. 5*a* with a second alternative connector release mechanism.
Figure 7B:
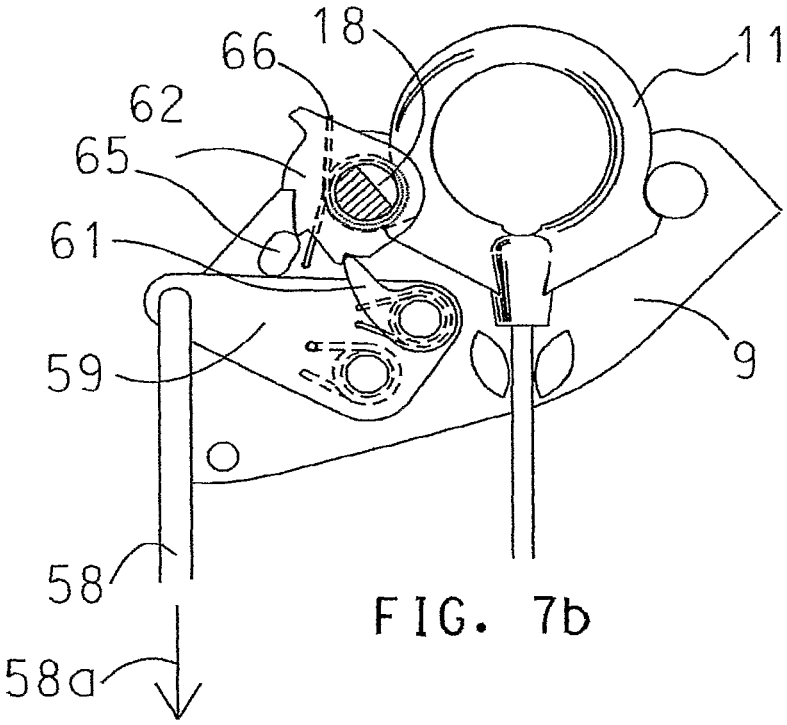
FIG. 7*b* shows FIG. 7*a* in a subsequent level of operation.
Figure 7C:
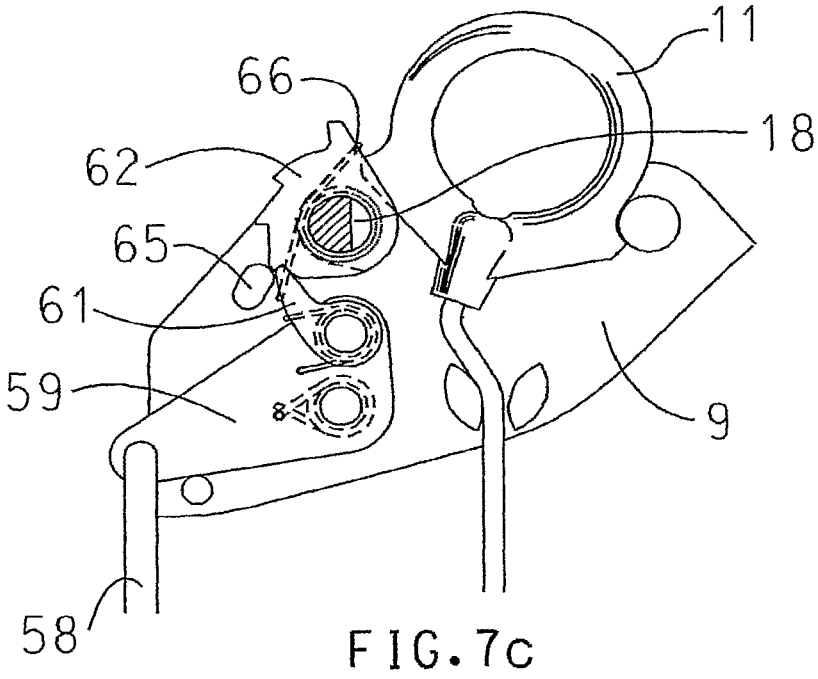
FIG. 7*c* shows FIG. 7*b* in a further level of operation.

FIGS. 7*a* through to 7*c* show a second alternative arrangement for releasing eye 11 whereby pull cord 58 is required to be pulled substantially in the direction of arrow 58*a* and then released but whereby the pull and release sequence is required to be carried more than one time consecutively. The embodiment shown includes a release mechanism requiring 3 consecutive pulls on pull cord 58 in order to release eye 11. In FIG. 7*a*, lever 62 is rigidly attached to pin 14 and has a stop 64 that bears on stop 65, stop 65 being attached to or part of casing 9. Torsion spring 66 is between lever 62 and casing 9 such that lever 62 tends to move in an anticlockwise direction relative to FIG. 7*a* towards stop 65. Lever 62 also has radial teeth that engage with pawl 61, pawl 61 being mounted on lever 59 such that it can rotate relative to lever 59 about axle 63. Lever 59 is able to rotate about axle 60 and has pull cord 58 attached to it. Axle 60 is attached to casing 9. Torsion spring 67 is between pawl 61 and lever 59 tending to urge cam 61 in a clockwise direction relative to FIG. 7*a* towards lever 62. Torsion spring 68 is between lever 59 and casing 9 tending to urge lever 59 in a clockwise direction relative to FIG. 7*a* towards stop 65. When pull cord 58 is pulled substantially in the direction of arrow 58*a* for the first time, pawl 61 engages with the first tooth of lever 62 and rotates both lever 62 and pin 14 through a limited arc in a clockwise direction. With insufficient load on eye 11 bearing on pin 14, the friction generated between eye 11 and pin 14 would be overcome by the strength of torsion spring 66 and so lever 62 would return to its original position when pull cord 58 is released. However, in the event that eye 11 is loaded with the weight of person 1 relative to pin 14, the friction generated between eye 11 and pin 14 would be sufficient to overcome the strength of torsion spring 66 such that, after the first pull of pull cord 58, lever 62 and pin 14 would be and remain rotated relative to eye 11. A further pull of pull cord 58 substantially in the direction of arrow 58*a* would engage cam 61 in the next tooth in lever 62 thereby rotating lever 62 through a further arc of rotation. FIG. 7*b* shows the start of a third pull of pull cord 58 substantially in the direction of arrow 58*a* and in FIG. 7*c* the third pull is shown as being completed whereby flat 18 in pin 14 is turned sufficiently to enable eye 11 to escape. This is a particularly safe method of release because it requires distinct consecutive pulls on pull cord 58 and if the load on eye 11 is insufficient to counteract torsion spring 66, lever 62 returns to its start position against stop 65. Whilst FIGS. 7*a* to 7*c* show an embodiment requiring three consecutive pulls of pull cord 58, other typical embodiments may require two or more pulls.

Figure 8:
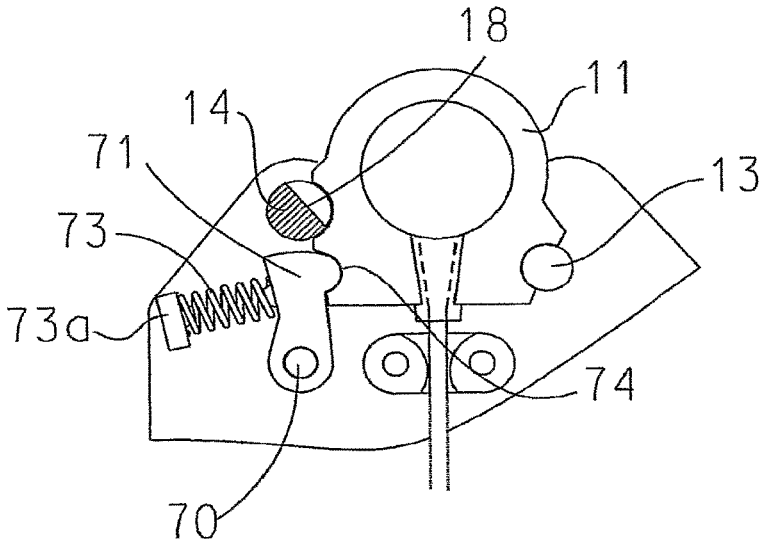
FIG. 8 shows a partially cut away view of a third alternative connector release mechanism.
Figure 9B:
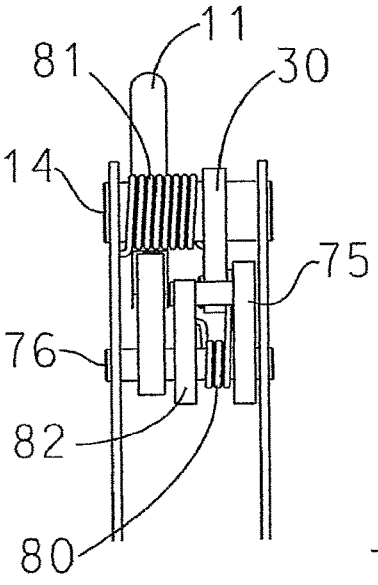
FIG. 9*b* shows an elevation partially cut away of FIG. 9*a;*
Figure 9A:
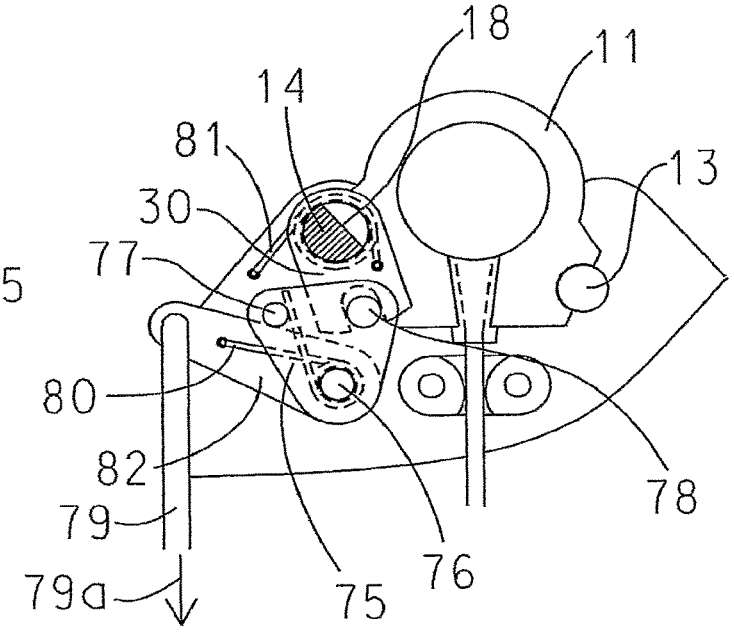
FIG. 9*a* shows a partially cut away view of a fourth alternative connector release mechanism.

FIGS. 8, 9*a* and 9*b* show a third and fourth alternative method of activating the release of eye 11 such that the release can only be activated between a minimum and maximum range of loads on eye 11 and whereby the range of loads specifically includes loads equating to the weight of a person but excludes light loads such as may be encountered during normal activities at height and also heavy loads such as would occur whilst arresting a fall. The embodiment in FIG. 8 shows a simple mechanism that would resist eye 11 being released below a predetermined threshold of load on eye 11. Lever 71 is able to rotate about axle 70 and axle 70 is secure in casing 9. Lever 71 also has a protruding surface 74 that interfaces with a mating surface on eye 11. Spring 73 is a compression spring between abutment 73*a* that is attached to or part of casing 9 and lever 71, and spring 73 has sufficient strength to push lever 74 against eye 11 such that if surface 18 on pin 14 were rotated into a position where eye 11 could otherwise escape, the engagement of protruding surface 74 on lever 71 would hold eye 11 in place up to a minimum threshold of magnitude of load between eye 11 and pin 14.

The embodiment in FIGS. 9*a* and 9*b* shows a mechanism that would resist eye 11 being released above a predetermined threshold of load on eye 11. Lever 30 is rigidly attached to pin 14 with flat surface 18 and there is torsion spring 81 tending to urge lever 30 and pin 14 to rotate in an anticlockwise direction relative to eye 11. Both levers 75 and 82 rotate about the same axle 76 and torsion spring 80 is arranged between levers 75 and 82 tending to urge lever 82 to rotate in a clockwise direction relative to FIG. 9*a* towards lever 75. Pull cord 79 is attached to lever 82. Pin 78 protrudes from the surface of lever 75 and engages with a slot form in lever 30 such that rotation of lever 75 about axle 76 also causes rotation of lever 30 about pin 14. If the load on eye 11 bearing on both pins 13 and 14 is higher than a predetermined maximum threshold limit, the friction generated between pin 14 and eye 11 will be greater than the strength of torsion spring 80 in the event that pull cord 79 is pulled substantially in the direction of arrow 79*a*. In such circumstances, pull cord 79 would cause lever 82 to rotate but lever 75 would be held by lever 30, which in turn is held by friction between pin 14 and eye 11. However, if friction between pin 14 and eye 11 was insufficient to overcome the strength of torsion spring 80 as would be the case if the load on eye 11 were below the predetermined upper threshold, then rotational movement of lever 82 activated by pull cord 79 would turn lever 75 that would then turn lever 30 and pin 14 allowing eye 11 to escape. Both embodiments shown in FIG. 8 and also in FIGS. 9*a* and 9*b* may be combined to provide a mechanism that will only allow release of eye 11 between a predetermined maximum and minimum threshold of load on eye 11.

Figure 10:
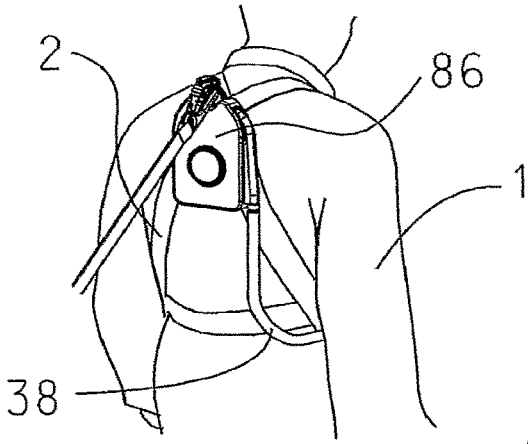
FIG. 10 shows a personal height rescue apparatus according to a second embodiment of the invention worn by a person.
Figure 11A:
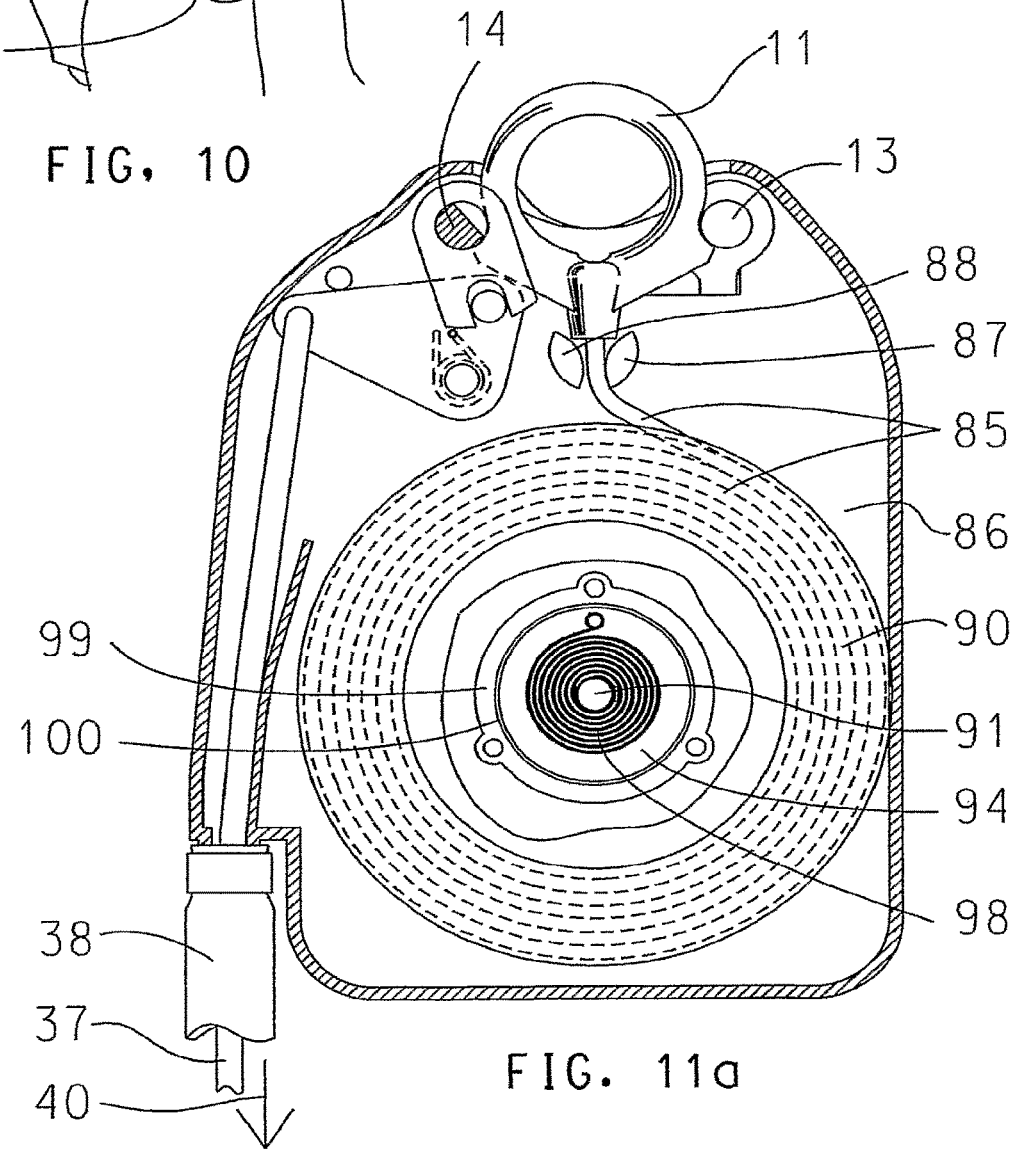
FIG. 11*a* shows a partially cut away view of the invention in FIG. 10.
Figure 11B:
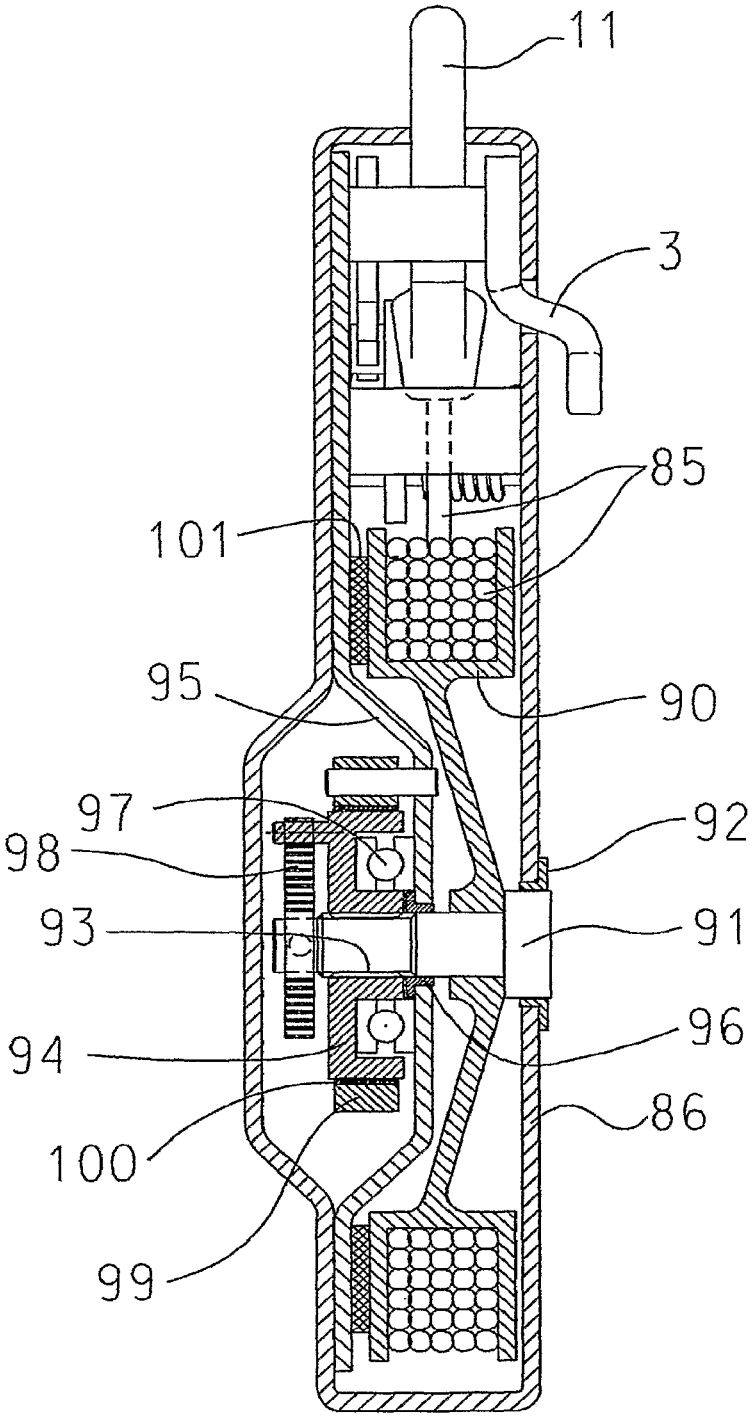
FIG. 11*b* shows an elevation partially cut away of FIG. 11*a;*

In FIGS. 10, 11*a* and 11*b*, a second embodiment of the personal height rescue apparatus is shown. In FIG. 10 the second embodiment is shown as worn on the back of person 1 whilst carrying out ordinary work duties at height. The second embodiment of the invention is the same as the first embodiment with respect to release mechanisms for releasing eye 11 and also with respect to the method for attaching the personal height rescue apparatus to harness 2 with the use of bracket 3. The main differences are in the means of storing and deploying flexible elongate whilst lowering a person after having been suspended following the arrest of a fall, and also the means of controlling the speed of deployment of flexible elongate and therefore the speed of the person's descent.

In FIGS. 11*a* and 11*b*, flexible elongate 85 is a length of flexible elongate attached at one to eye 11 and passed through guides 87 and 88 before being helically wound onto drum 90 in a clockwise direction relative to FIG. 11*a*. The other end of flexible elongate 85 is securely attached to drum 90. Drum 90 is rigidly attached to pin 91. At one end of pin 91 there is a headed portion that is able to rotate within axial bearing 92, axial bearing 92 being secured to casing 86, so that both drum 90 and pin 91 can rotate together within axial bearing 92. Pin 91 also passes through axial bearing 96 that is secured in structure 95, structure 95 being rigidly attached to or is part of casing 86. Beyond structure 95, pin 91 has a threaded portion shown as thread 93 that is typically right handed. Nut 94 is a specially formed nut that has a central threaded hole that is threaded onto thread 93 of pin 91. Therefore, drum 90, pin 91 and nut 94 can rotate together with respect to casing 86. Spiral spring 98 is attached between nut 94 and pin 91 tending to urge nut 94 to rotate in an anticlockwise direction relative to pin 91 such that spiral spring 98 tends to urge the thread on nut 94 to unwind with respect to thread 93 on pin 91. Speed control disc 99 is a disc that is attached to structure 95 and retains a viscous material 100 such that the viscous material is disposed between speed control disc 99 and nut 94. The viscous material is intended to cause a predetermined drag between nut 94 and structure 95 such that when drum 90 rotates in an anticlockwise direction relative to FIG. 11*a* the threaded part of nut 94 tends to wind onto thread 93 of pin 91 towards drum 90. When pull cord 37 is pulled substantially in the direction of arrow 40 to release eye 11, drum 90 rotates in an anticlockwise direction with respect to casing 86 and relative to FIG. 11*a* deploying flexible elongate 85 from drum 90. The strength of spiral spring 98 tends to unwind nut 94 with respect to pin 91 thereby allowing drum 90 to rotate. However, when the rotational speed of drum 90 exceeds a predetermined limit, the viscous drag imparted by viscous material 100 between nut 94 and structure 95 tends to overcome the strength of spiral spring 98 and cause the threaded part of nut 94 to wind onto thread 93 of pin 91 such that both pin 91 and drum 90 move towards nut 94. Friction disc 101 is a disc made of a friction material that has a substantially predetermined coefficient of friction between itself and the mating surfaces of structure 95 and drum 90 such that when pin 91 and drum 90 move towards friction disc 101, and structure 95 and drum 90 interacts with friction disc 101, the rotational speed of drum 90 is reduced until the strength of spring 98 exceeds the viscous drag imparted by viscous material 100 thereby tending to unwind the threaded part of nut 94 with respect to thread 93 of pin 91 such that drum 90 tends to move away from friction disc 101 thereby reducing resistance to the rotational movement of drum 90. Ball bearing 97 separates nut 94 and structure 95 such that nut 94 is prevented from becoming locked to structure 95. Without ball bearing 97, nut 94 could become locked to structure 95 due to friction that would develop between their mating surfaces so that spiral spring 98 would be unable to overcome the friction and therefore be unable unwind nut 94 with respect to pin 91 when the rotational speed of drum 90 has reduced below a predetermined limit.

Hence, in the above embodiment, the rotational speed of drum 90 is effectively controlled and the speed of descent of person 1 is effectively limited. A manually controlled brake could easily be added with a mechanism that simply applies drag to nut 94 in addition to the viscous drag applied by viscous material 100. Such a mechanism could then be linked to a pull cord, or other suitable operation means, in order to operate the brake by pulling the pull cord.

Whilst the automatic speed control applied to drum 90 is shown as being applied by viscous material 100 causing drag on nut 94, the application of drag could be any other suitable means providing dynamic drag that is related to the speed of rotation of drum 90 thereby limiting the speed of descent of person 1 after eye 11 has been released. In the event that the length of flexible elongate 85 is insufficient to lower person 1 to a safe level, flexible elongate 85 would be prevented from leaving drum 90 as a result of its end being securely attached to drum 90. Also, the flexible elongate 85 could be any suitable material and cross section. However, in practice, it has been found that steel cable is both strong and compact when wound around a drum. High strength polymer rope may be used particularly as it is strong, compact and lighter than steel cable. Polymer tape such as webbing may also be used.

Figure 12A:
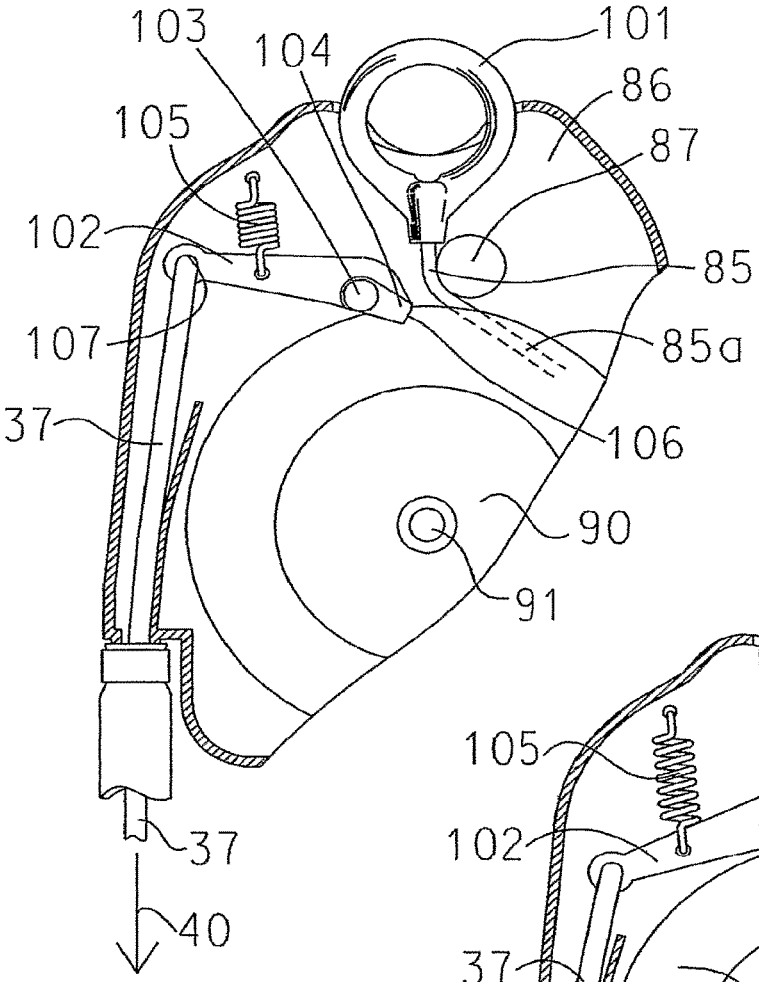
FIG. 12*a* shows a partially cut away view of the invention in FIG. 10 with an alternative method of releasing the deployment of flexible elongate.
Figure 12B:
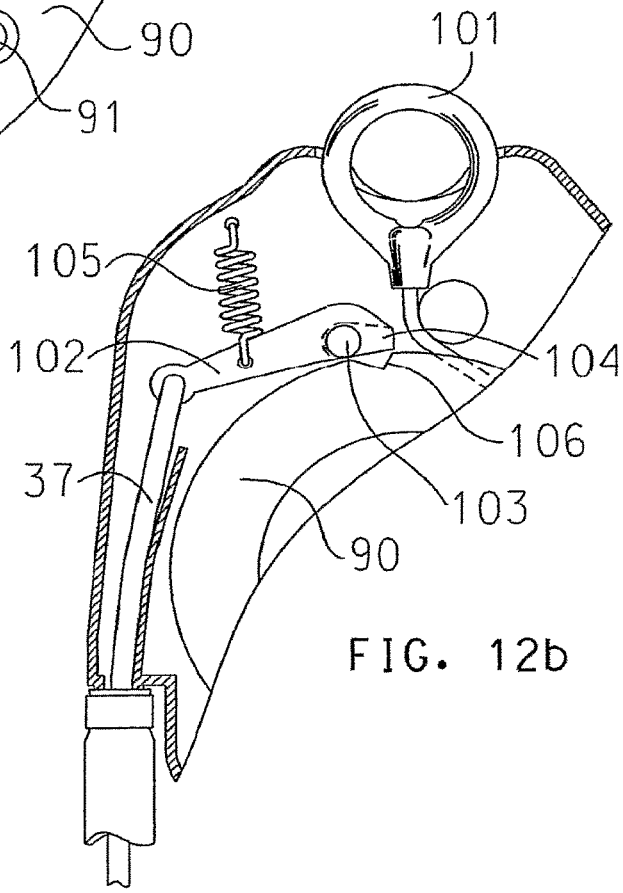
FIG. 12*b* shows a partially cut away view of the invention in FIG. 12*a* in a second level of operation.

FIGS. 12*a* and 12*b* show an arrangement that is similar to the arrangement in FIGS. 11*a* and 11*b* except that the releasable connector acting on eye 11 is replaced with a releasable stop that prevents drum 90 from rotating and therefore from deploying flexible elongate and imparting dynamic fall arrest loading to the speed control mechanism that controls the speed that flexible elongate is deployed from the drum, until the releasable stop is released. In FIG. 12*a* a first end of flexible elongate 85 is fixed to drum 90 and then a substantial part of the length of flexible elongate is helically wound onto drum 90, its second end being securely attached to eye 101. Eye 101 is notable in that it does not have any substantial features that could prevent it from moving away from drum 90. As in FIGS. 11*a* and 11*b*, drum 90 may rotate about axle 91 whereby axle 91 is secured between parallel sides of casing 86. There is also a mechanism for controlling the speed of rotation of drum 90 similar to that in FIGS. 11*a* and 11*b*, although this is not explicitly shown. Pawl stop 104 is attached to or is integral with lever 102 and lever 102 is able to rotate with respect to housing 86 about its axle 103 that is secured to and disposed between two parallel sides of housing 86. Tension spring 105 urges lever 102 to tend to rotate in a clockwise direction relative to FIGS. 12*a* and 12*b*. In a dynamic fall arrest situation, dynamic fall loads would be applied to eye 101 in a direction away from drum 90 such that the dynamic fall loads would be imparted to flexible elongate 85 and therefore tend to cause the rotation of drum 90. However, in order to prevent drum 90 from rotating, in an anticlockwise direction relative to FIGS. 12*a* and 12*b*, and thereby imparting relatively high dynamic fall loading to the speed control mechanism, pawl stop 104 as shown in FIG. 12*a* is engaged in a cut-out detail 106 in the rim of drum 90 stopping its rotation. A line drawn between axle 103 and the engagement surface between pawl stop 104 and cut-out detail 106 is ideally substantially parallel to length portion 85*a* of flexible elongate 85 such that tensile loading applied to length portion 85*a* is substantially counteracted by pawl stop 104 at its axle 103 thereby minimizing loading between drum 90 and its axle 91. After a dynamic fall arrest situation is concluded, pull cord 37 may be pulled in the direction of arrow 40 thereby also pulling its attachment 107 to lever 102 against the urging load applied by tension spring 105, such that lever 102 rotates in an anticlockwise direction relative to FIGS. 12*a* and 12*b* until the degree of rotation is sufficient to release pawl 104 from its engagement with drum 90 at its cut-out detail 106. Drum 90 is then free to rotate and thereby deploy flexible elongate 85 and at a speed of deployment controlled by the speed control mechanism. Clearly, any of the preceding methods for operating the release means and releasing a releasable connector in FIGS. 5*a* through to 11*b* could equally be applied to releasing pawl stop 104. Also, there are many different arrangements that could be used for stopping flexible elongate 85 and/or its deployment means such as drum 90 from moving during a fall being arrested thereby preventing dynamic fall arrest loads from being imparted to the speed control mechanism. A disadvantage with acting on the flexible elongate or flexible elongate deployment means to stop movement of the flexible elongate instead of using a releasable connector acting on a releasable eye as shown in FIGS. 5*a* to 11*b*, is that dynamic fall arrest loading is imparted to at least part of the length of the flexible elongate 85 particularly between eye 101 and the initial helical winding onto drum 90. In order to minimize the size and weight of the flexible elongate, the relatively highly loaded part of its length could have greater strength than the remaining part. This greater strength could be provided in various ways including simply increasing the cross sectional area of the flexible elongate along the part of its length that is relatively highly loaded or by specifying a stronger material for this part of its length. Alternatively, more than one length of flexible elongate may be arranged in parallel and secured together along the part of the length of flexible elongate that is relatively highly loaded or the flexible elongate could be looped around an attachment to eye 101 such that the looped length is also wound helically onto drum 90 until the load is reduced by radial friction effects in order to effectively double the strength capability in the relatively highly loaded part of its length.

Figure 13A:
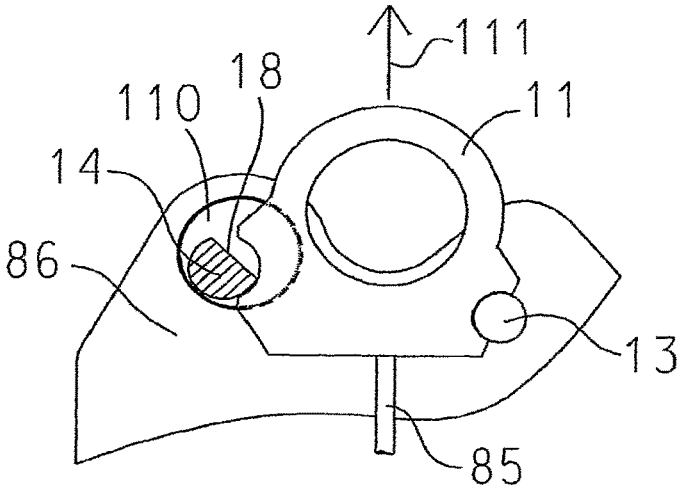
FIG. 13*a* shows a partially cut away view of the invention applied either to FIG. 1 or FIG. 10 showing a possible automatic release mechanism.
Figure 13B:
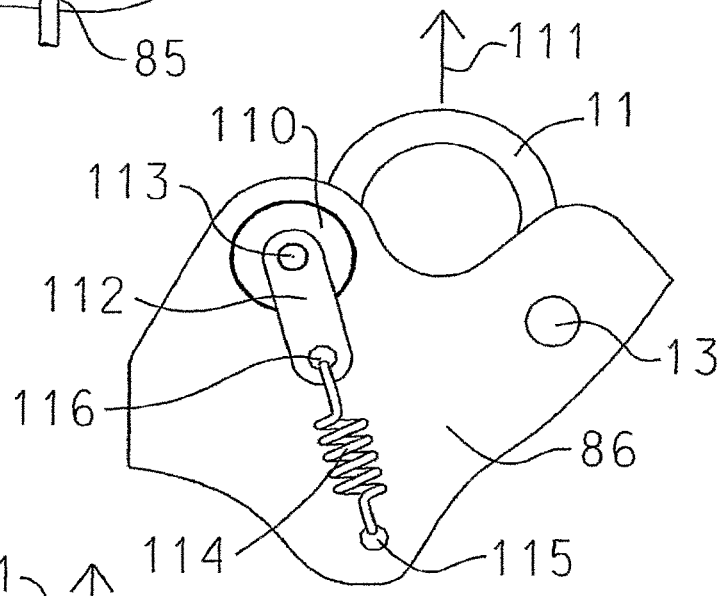
FIG. 13*b* shows a partially cut away view of the invention in FIG. 13*a;*
Figure 13C:
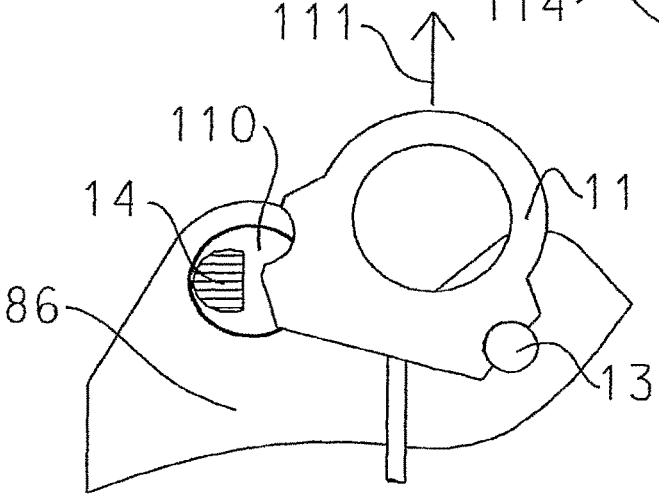
FIG. 13*c* shows a partially cut away view of the invention in FIGS. 13*a* and 13*b* in a second level of operation.

FIGS. 13*a* to 13*c* show a means for releasing eye 11 automatically such that release is activated when the load applied to eye 11 is within both an upper and a lower predetermined limit. When a person is equipped with the personal height rescue apparatus in normal use, not involving a fall event, the person may use his attachment to a secure anchorage as means for restraining his position or to recover from a stumble or slip and so it is desirable in such circumstances that eye 11 is not released. Therefore, the lower predetermined limit below which eye 11 cannot be activated will be typically determined by the weight of the lightest person that is equipped with a personal height rescue apparatus. A typical lower limit may be about 400 N. In order to ensure that the flexible elongate cannot be deployed until the process of being arrested from a fall is substantially concluded, the upper predetermined limit of load will typically be determined by the weight of the heaviest person that is equipped with a personal height rescue apparatus. A typical upper limit may be about 2000 N.

In FIG. 13*a*, pins 13 and 14 restrain eye 11. Pin 13 is fixed between parallel sides of casing 86. Pin 14 is cylindrical with a flat 18 along its length and is fixed or is an integral part of the larger diameter pin 110. Pin 110 is secured between parallel sides of casing 86 such that it can rotate about its central axis relative to casing 86. When a load is applied to eye 11 typically in the direction of arrow 111, eye 11 bears on pin 14 tending to rotate the larger pin 110 in a clockwise direction relative to FIG. 13*a* and casing 86, as a result of the location of pin 14 being offset from the center of pin 110. FIG. 13*c* shows how such rotation of pin 110 eventually results in eye 11 being able to escape the restraints provided by both pins 13 and 14. However, in FIG. 13*a*; friction between the interconnecting surfaces of pin 110 and casing 86 is sufficient to prevent rotation of pin 110 if the loading on eye 11, typically in the direction of arrow 111, is greater than a predetermined upper limit of about 2000 N. FIG. 13*b* shows a view of FIG. 13*a* but outside one of the parallel sides of casing 86. Link 112 is secured at a first end to pin 113 such that it can rotate about pin 113 and its second end is attached to tension spring 114. Tension spring 114 is also attached to casing 86 at attachment location 115 such that it urges link 112 to move towards location 115. Pin 113 is typically fixed to or is an integral part of pin 110 and the central axis of both pins are aligned. When eye 11 is lightly loaded in the direction of arrow 111, tension spring 114 urges pin 110 to bear on casing 86 such that the friction between the interconnecting surfaces of pin 110 and casing 86 prevent rotation of pin 110 if the loading on eye 11, typically in the direction of arrow 111, is less than a predetermined lower limit of about 400 N. If, however, the loading on eye 11 is within the upper and lower predetermined limits, loading between pin 110 and casing 86 will tend to be relieved by the counteraction of eye 11 and tension spring 114 such that the friction between pin 110 and casing 86 is relatively small and pin 110 can therefore rotate in casing 86. Also, pin 113 can rotate relatively easily in the relatively small diameter hole in link 112.

Figure 13D:
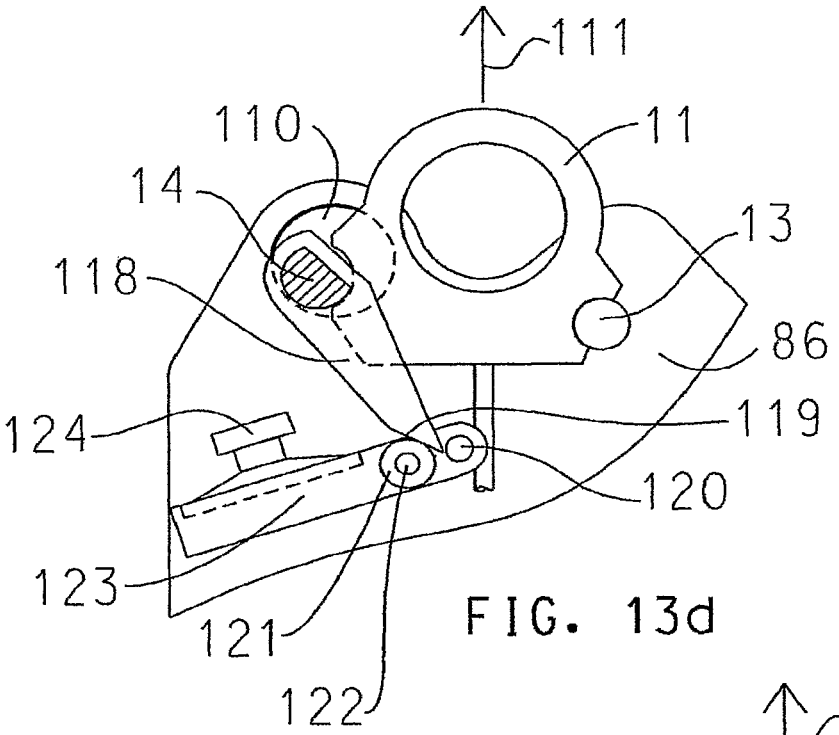
FIG. 13*d* shows a partially cut away view of the invention in FIGS. 13*a* through to 13*c* with a mechanical time delay arrangement.
Figure 13E:
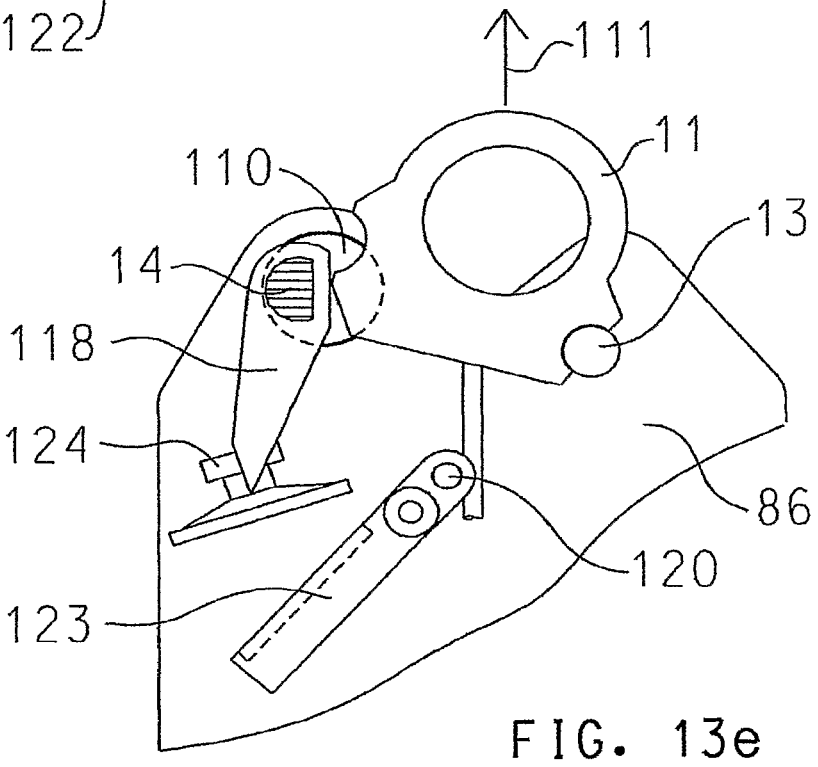
FIG. 13*e* shows a partially cut away view of the invention in FIG. 13*d* in a second level of operation.

FIGS. 13*d* and 13*e* show a means for delaying the release of eye 11 in FIGS. 13*a* to 13*c* for a predetermined time interval. The embodiment in FIGS. 13*a* to 13*c* would allow eye 11 to be released when the load on eye 11 is between an upper and lower limit. However, this may occur during the process of arresting a fall rather than when the process is substantially completed. Therefore, it is desirable to include a time delay to ensure that a load between the upper and lower limits has been sustained for a time interval typically of about 30 seconds to allow sufficient time for any dynamic fall arrest event to be concluded before releasing eye 11. In FIG. 13*d*, lever arm 118 is fixed to or is integral with pin 110 and pin 14. When a load is applied to eye 11 typically in the direction of arrow 111 and within the predetermined upper and lower limits, lever arm 118 is urged to rotate with pin 110 in a clockwise direction relative to FIGS. 13*d* and 13*e*. At the end of lever arm 118 away from its attachment to pin 110, lever arm 118 bears on roller 121 that can roll about axle 122. Axle 122 is attached to receptacle 123 and receptacle 123 is able to rotate about pin 120, pin 120 being attached to or disposed between parallel sides of casing 86 such that lever arm 118 urges receptacle 123 to rotate in an anticlockwise direction relative to FIG. 13*d*. Sucker 124 is fixed to casing 86 and has a flexible diaphragm. Receptacle 123 is pressed against sucker 119 in FIG. 13*d* creating a vacuum or partial vacuum within sucker 119 such that receptacle is urged to adhere to sucker 119. The action of lever arm 118 bearing on roller 121 tends to separate receptacle 123 from sucker 119. Sucker 119 has a small hole through which air can leak until, after a predetermined period of time has elapsed, the vacuum in sucker 119 is filled sufficiently so that sucker 119 is no longer urged to adhere to receptacle 123. Typically, receptacle 123 would be urged by a spring (not shown diagrammatically) towards diaphragm 124 to ensure that the vacuum or partial vacuum within sucker 119 is maintained during normal use of the personal height rescue apparatus and, more particularly, that it can be reset if the load on eye 11 should vary between and outside the upper and lower limits. For example, this reset facility would be required if a faller were to oscillate or bounce after being initially arrested from a fall, due to any elasticity in the fall arrest equipment or system. The effects of bouncing would apply a wide range of loading on eye 11 that may be both within and outside the upper and lower limits.

In the preceding embodiments, both eye 11 to which the lanyard is attached and bracket 3 to which the harness is attached are rigidly attached to housing 9 so that when load is applied between eye 11 and bracket 3 in the event of arresting someone falling, housing 9 may be urged to rotate about bracket 3 as eye 11 and bracket 3 tend to align with the applied load. This is not generally a problem if a faller falls feet first (in a substantially upright position with head above body and body above feet) because there is unlikely to be any rotation of housing 9 about bracket 3 towards the faller's body and therefore little, if any, load imparted on housing 9. However, if the faller falls in a prone position with head, feet and body at substantially the same level, and the rescue device is mounted on the faller's back, housing 9 will tend to rotate into the faller's back as eye 11 and bracket 3 are urged to align with the applied load to arrest a fall. As the lower edge of housing 9 contacts the faller's back, eye 11 and bracket 3 will be restricted in the extent to which they can align with the applied load causing all three components to be loaded awkwardly, particularly housing 9. The rotation of housing 9 and its contact load on the faller's back may be sufficient to cause injury. The same applies if the faller should fall head first with body and feet above the head.

Figure 14A:
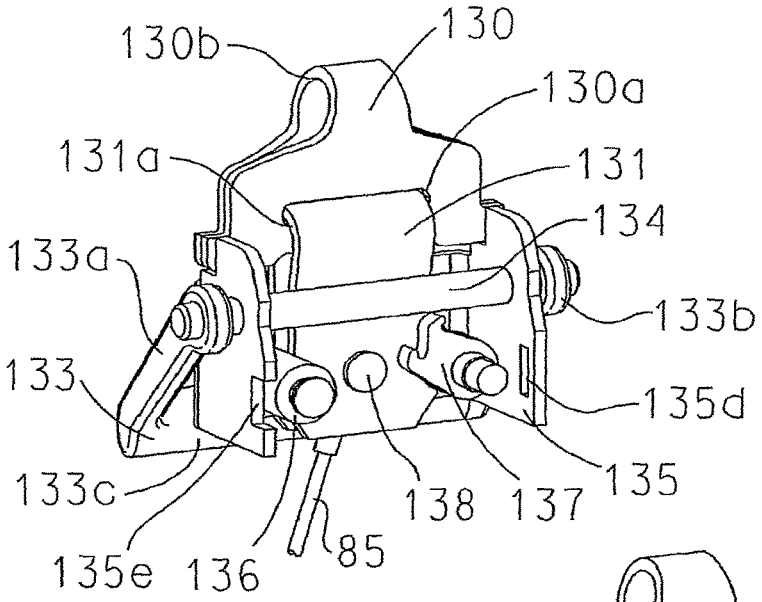
FIG. 14*a* shows a view of the invention with an alternative arrangement for the lanyard, harness and rescue line attachments in a first level of operation.

In practice, it is difficult to determine how someone will fall and so it is necessary to provide for all feasible eventualities. FIGS. 14*a* through to 14*e* show a preferred embodiment that provides for different modes of falling by allowing articulation between housing 9 and both the lanyard attachment means and the harness attachment means. Eye 11 in preceding embodiments is replaced with eye 130 and anchor 131.

Figure 14B:
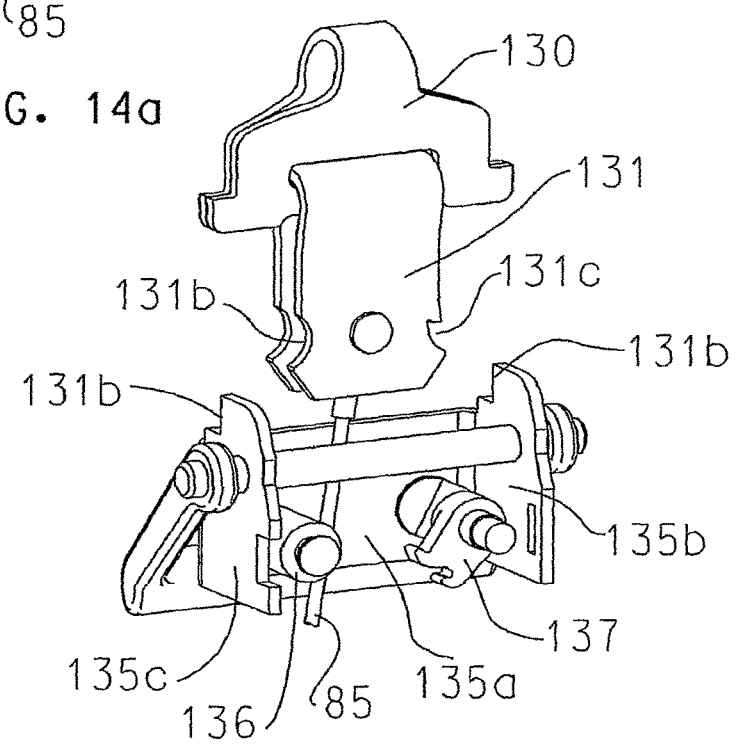
FIG. 14*b* shows a view of the invention in FIG. 14*a* in a second level of operation.

In FIGS. 14*a* and 14*b*, both eye 130 and anchor 131 are each shown as folded from sheet material to form a loop in each and eye 130 has an elongated aperture 130*a* through which anchor 131 is passed so that both eye 130 and anchor 131 are effectively securely attached to each other when elongated aperture 130*a* bears on loop 131*a* in anchor 131. Also, eye 130 is able to rotate about the radial axis of the folded loop 131*a* in anchor 131. Folded loop 130*b* in eye 130 is provided to enable a removable fastener such as a to karabiner, typically at the end of a lanyard or other safety line, to be passed through loop 130*b* to achieve a secure attachment to eye 130. Harness bracket 133 has two parallel arms 133*a* and 133*b* spaced apart with an adjoining bar 133*c* that is perpendicular to each arm and securely fixed to or part of one end of each arm. Axle 134 is attached to the other end of each arm and is securely located in structure 135 such that harness bracket 133 can rotate with respect to structure 135 about the axis of axle 134. Anchor 131 is also effectively secured to structure 135 whereby cut outs 131*b* and 131*c*, shown in FIG. 14*b* in anchor 131, engage with cylindrical stop 136 and cam stop 137 respectively. Structure 135 is shown as being formed from a flat sheet of material with a back 135*a* and two parallel sides 135*b* and 135*c* perpendicular to back 135*a* and formed, for convenience, by folding two opposing edges of the sheet material. One end of cylindrical stop 136 is fixed to and with its cylindrical axis perpendicular to the plane of back 135*a* of structure 135. A front plate, not shown in FIGS. 14*a* and 14*b*, is positioned with its plane parallel to and spaced apart from back 135*a* of structure 135 and is located in apertures 135*d* and 135*e*. The other end of cylindrical stop 136 is then securely fixed to the said front plate so that structure 135 and the said front plate are also effectively rigidly attached to each other. Cam stop 137 is secured between structure 135 and said front plate and is able to rotate about an axis parallel and apart from the axis of cylindrical stop 136. Therefore, in FIG. 14*a*, eye 130 and harness bracket 133 are both secured to structure 135 and able to rotate on substantially parallel axes with respect to each other and to structure 135.

Figure 14D:
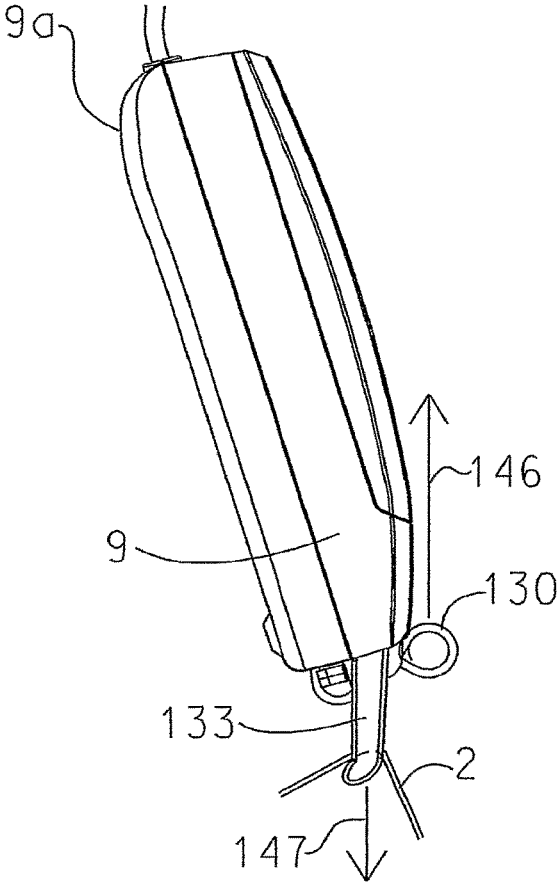
FIG. 14*d* shows a side view of the invention in FIG. 14*a* including a housing in a second mode of a person falling.
Figure 14C:
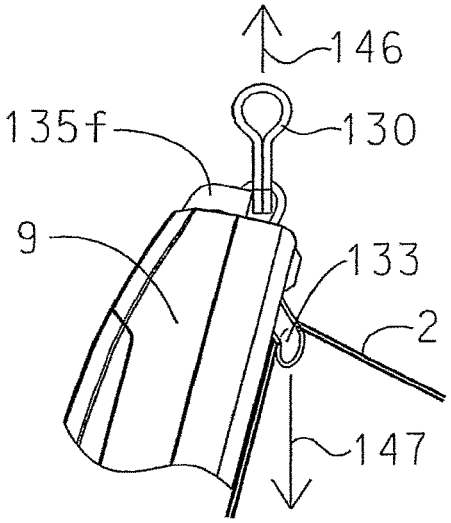
FIG. 14*c* shows a side view of the invention in FIG. 14*a* including a housing in a first mode of a person falling.
Figure 14E:
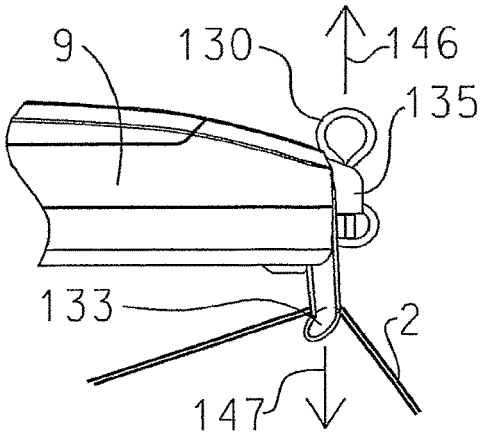
FIG. 14*e* shows a side view of the invention in FIG. 14*a* including a housing in a third mode of a person falling.

FIGS. 14*c* to 14*e* show eye 130 and harness bracket 133 articulating with respect to housing 9 for different fall positions, eye 130 being loaded in the direction of arrow 146 and bracket 133 being loaded in the direction arrow 147. In all FIGS. 14*c* to 14*e*, structure 135 is attached to and housed within housing 9. FIG. 14*c* shows an alignment of eye 130 and harness bracket 133 with housing 9 assuming a position that would be typical if someone was to fall feet first and where there is no significant load on housing 9 since there is no tendency for housing 9 to rotate about harness bracket 133 towards harness 2 and the faller's body. FIG. 14*d* shows an alignment of eye 130 and harness bracket 133 that would be typical if someone fell headfirst. Whilst, in FIG. 14*d*, there is some tendency for housing 9 to rotate about harness bracket 133 towards harness 2, the load on the faller's back is unlikely to be injurious and can be mitigated by the rounded form in the region of 9*a* on housing 9 to spread load on the faller's back. FIG. 14*e* shows an alignment of eye 130 and harness bracket 133 that would be typical of someone falling in a prone position with head, body and feet at substantially the same vertical level and where, as in FIG. 14*c*, there is no significant load on housing 9 due to any tendency for housing 9 to rotate about harness bracket 133 towards harness 2 and therefore the faller's body. In FIG. 14*e*, eye 130 leans on protruding abutments 135*f* and 135*g* on structure 135, as shown in FIG. 14*b*, to avoid anchor 131 from being excessively loaded other than in the direction in which it may be eventually be released as in FIG. 14*b*.

In FIG. 14*b*, cam stop 137 shares some similarities with lever 62 in FIG. 7*a*. In its normal radial position whilst a fall is being arrested, cam stop 137 presents a substantially cylindrical surface to engage in cut out 131*c* in anchor 131. However, when cam stop 137 is rotated in an anti-clockwise direction relative to FIG. 14*a* and to an extent as shown in FIG. 14*b*, the cylindrical surface is rotated away from cut out 131*c* and replaced with a flat cut away region that allows anchor 131 and therefore eye 130 to escape from structure 135. Pin 138 is located securely in anchor 131 and one end of flexible elongate 85 is terminated typically with the elongate formed in a closed loop and the loop restrained with a component such as a ferrule and the loop is then attached securely around pin 138.

In practice, it has been found that the method shown in both FIGS. 11*a* and 11*b* for housing flexible elongate 21 and controlling the speed of its deployment is advantageous because friction disc 101 is the principal means for reducing the rotational speed of drum 90 whereas viscous material 100 only acts as a servo mechanism for controlling the force with which drum 90 is brought to bear on friction disc 101. This means that the viscous drag required by viscous material 100 to control drum 90 is relatively small so that the servo mechanism can be relatively lightweight and economic to manufacture. However, viscous material can present a problem because of the tendency for its viscosity to change depending on its temperature so that as the rescue apparatus is used to descend a person, some heat dissipated within the apparatus may transfer to viscous material 100 and affect its viscous drag characteristics. An alternative is to use a centrifugal brake mechanism and an embodiment of this is shown in FIGS. 15*a* and 15*b*.

Figure 15A:
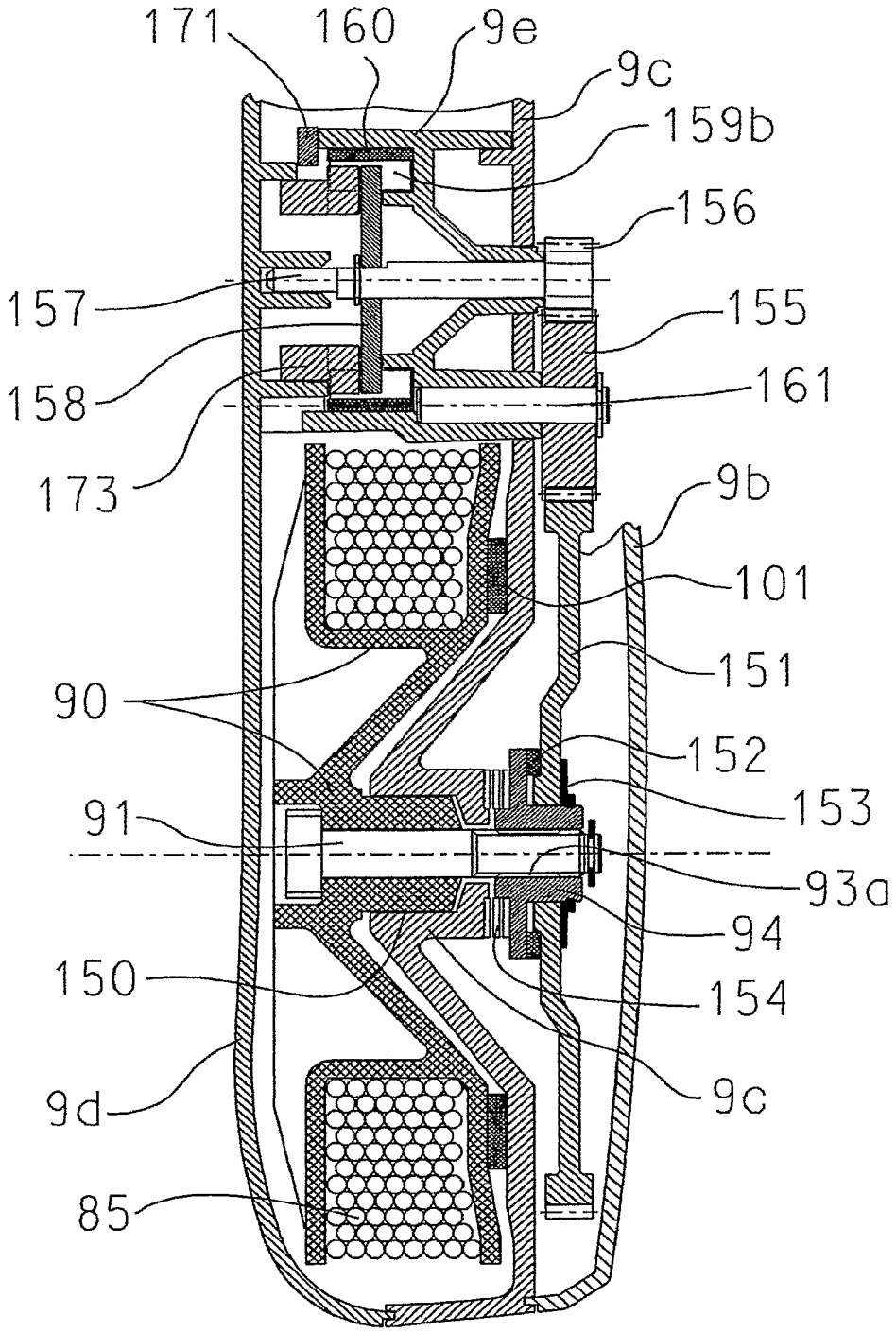
FIG. 15*a* shows a partially cut away view of the invention with a centrifugal dynamic servo braking arrangement.
Figure 15B:
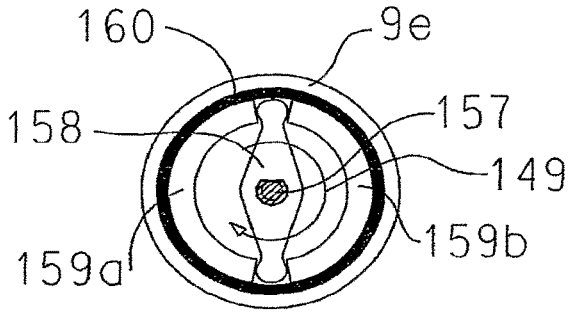
FIG. 15*b* shows a view of part of the invention in FIG. 15*a;*

As in FIGS. 11*a* and 11*b*, the embodiment in FIG. 15*a* has flexible elongate 85 being helically wound onto drum 90. One end of flexible elongate 85 is attached to a component such as anchor 131 in FIGS. 14*a* and 14*b* and the other end is securely attached to drum 90, not shown in FIG. 15*a*. Drum 90 is rigidly attached to pin 91 and both are able to rotate within bearing surface 150 that is part of housing 9*c*. Pin 91 has a threaded region 93*a* that is engaged in a mating threaded region in a specially formed nut 94. Nut 94 passes through the center of a spur gear, drive gear 151, and is frictionally adhered to drive gear 151 by means of brake lining ring 152 and spring washer 153 such that relative rotational movement between nut 94 and drive gear 151 is prevented until opposing torque between nut 94 and drive gear 151 exceeds a predetermined limit. Thrust bearing 154 minimizes friction effects between nut 94 and housing 9*c*. When drum 90 and pin 91 rotate together in the direction of tightening the mating screw surfaces between pin 91 and nut 94, nut 94 will tend to unwind with respect to pin 91 because there is no significant friction between nut 94 and housing 9*c* due to thrust bearing 154. Therefore, as drum 90 rotates with respect to housing 9*c*, drive gear 51 will also tend to rotate in the same direction.

Drive gear 151 intermeshes with a spur gear, idler gear 155, and idler gear 155 is free to rotate about spindle 161. Idler gear 155 intermeshes with a spur gear, pinion gear 156. Pinion gear 156 is rigidly attached to spindle 157 and spindle 157 is attached to shoe drive arm 158 such that spindle 157 and shoe drive arm 158 are constrained to rotate together. As also shown in FIG. 15*b*, shoe drive arm 158 is locate between shoes 159*a* and 159*b* and both shoes 159*a* and 159*b* can rotate within and about the cylindrical axis of cylindrical friction lining 160 that is housed in housing 9*e*, housing 9*e* being located between housing 9*c* and 9*d* such that rotation of drive gear 151 will result in the rotation of shoes 159*a* and 159*b*. As shoes 159*a* and 159*b* rotate, the mass and rotation speed of each shoe will determine the magnitude of the radial force between each shoe and cylindrical friction lining 160 such radial force being translated into a tangential braking force that is then translated through the spur gear train back to drive gear 151. The resultant drag on gear 151 will also apply drag on nut 94 such that ongoing rotation of drum 90 will tend to tighten pin 91 into the mating thread in nut 94. As pin 91 is drawn towards nut 94, drum 90 is also drawn towards friction disc 101, friction disc 101 being constrained not to rotate with respect to housing 9*c*, thereby reducing the rotational speed of drum 90. As the speed of drum 90 reduces further, the rotational speed of drive gear 151 and ultimately the rotational speed of shoes 159*a* and 159*b* reduces thereby also reducing the centrifugal drag tending to tighten nut 94 onto pin 91. Eventually, the centrifugal drag will reduce to an extent where the thread of nut 94 tends to unwind with respect to pin 91 allowing drum 90 to move away from friction disc 101 and freeing drum 90 so that its rotational speed can increase again. In this way, the centrifugal brake acts as a dynamic servo mechanism to regulate the braking force between drum 90 and friction disc 101 depending on the rotational speed of drum 90 and thereby controls the speed of deployment of flexible elongate 85 from drum 90. The significant advantage of this arrangement is that the centrifugal braking mechanism can be relatively low strength and lightweight because it is the friction between drum 90 and friction disc 101 that is doing the principal work slowing the speed of drum 90. Because of the relatively small mechanical load demands on such a servo mechanism, it has been found that both drive gear 151 and idler gear 155 can typically be made from plastic.

In preferred embodiments, it has been found that it is advantageous for the mating screw thread surfaces between pin 91 and nut 94 to be coated in a low friction material and also for the thread to have a nonstandard extended pitch size to increase the tendency for nut 94 to unwind with respect to pin 91.

During the process of a person descending to the ground or to a safe level with the rescue apparatus, it is possible that the person could temporarily alight on an abutment in the rescue path and then undergo a secondary fall. In a worst case scenario, a secondary fall could involve some free fall where the person falls through a vertical distance without flexible elongate being deployed from drum 90. In such a situation, at the end of the free fall distance, rotation of drum 90 will accelerate sharply and quickly reach a speed that would engage the centrifugal servo brake and bring drum 90 to bear on friction disc 101 with a relatively high force that could be transmitted to the person being descended as well as the rescue apparatus itself. To mitigate against this effect, as shown in FIG. 15*a*, the predetermined frictional adherence between nut 94 and drive gear 151, as a result of spring washer 153 urging nut 94 and drive gear 151 to bear on brake lining ring 152, would be overcome and drum 90 and nut 94 would rotate independently of drive gear 151 thereby ensuring that load on flexible elongate 85 never exceeds a predetermined limit effectively limiting load on the person and flexible elongate 85 to within a safe level typically around 2.5 kN or 3 kN. Input fall energy as a result of the free fall would be absorbed at least in part by the multiple of load resisting rotational movement of drum 90 and the extent to which drum 90 turns When a person is descended through a distance at a controlled speed, much of the energy absorbed as a result controlling descent speed will be translated into heat. Whilst this is not normally a problem, it is sensible to manage the distribution of heat within the rescue device particularly in the vicinity of plastic components. In practice, it has been found that heat can be effectively stored in drum 90 if it is made from aluminum and where friction disc 101 is constrained by housing 9*c* not to rotate with drum 90. Also, if flexible elongate 85 is made from galvanized steel wire, the wire itself can store heat and dispense it, albeit slowly, as the wire is deployed from the rescue device. Alternatively, if flexible elongate 85 is made from a fiber rope that is vulnerable to heat, housing 9*c* may be made from aluminum and friction disc 101 could be constrained by drum 90 to rotate with drum 90.

Figure 16A:
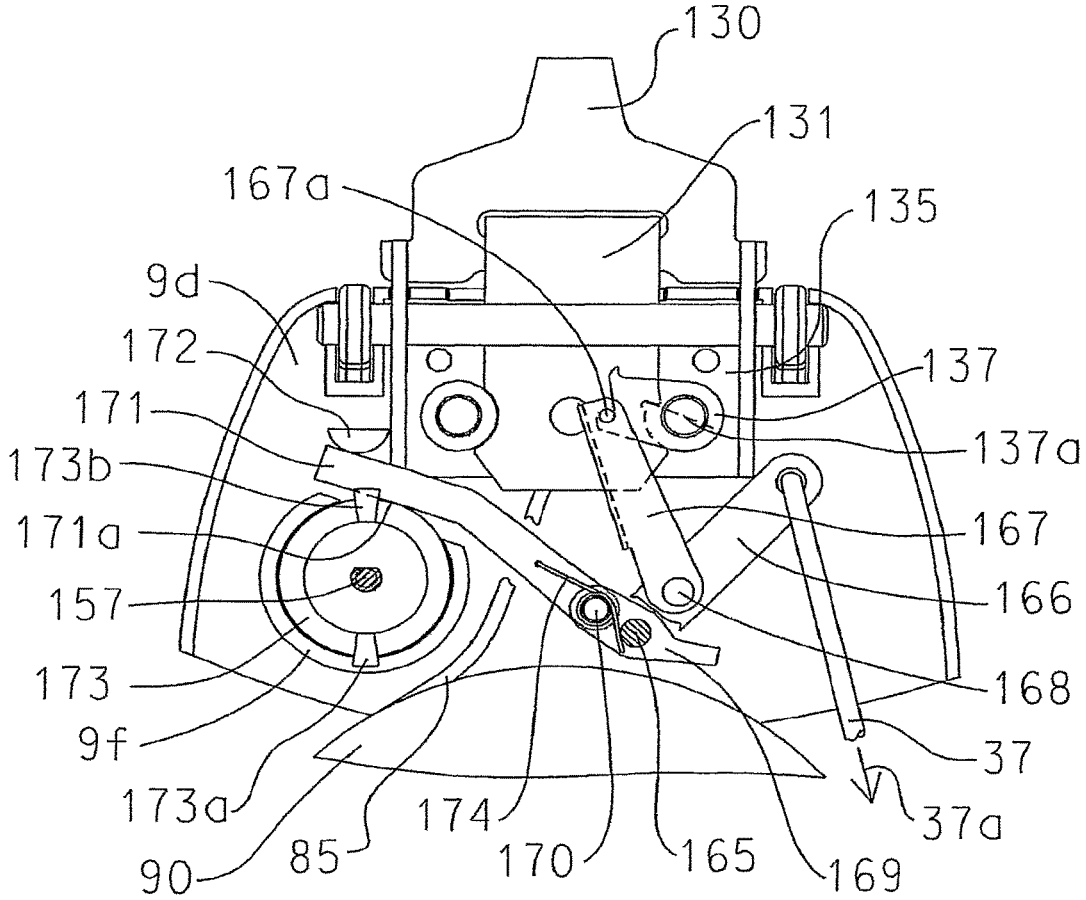
FIG. 16*a* shows a partially cut away view of the invention in FIGS. 14*a* through to FIG. 15*b* inclusive in a first level of operation with a brake operated by the pull cord that also releases the connector.
Figure 16B:
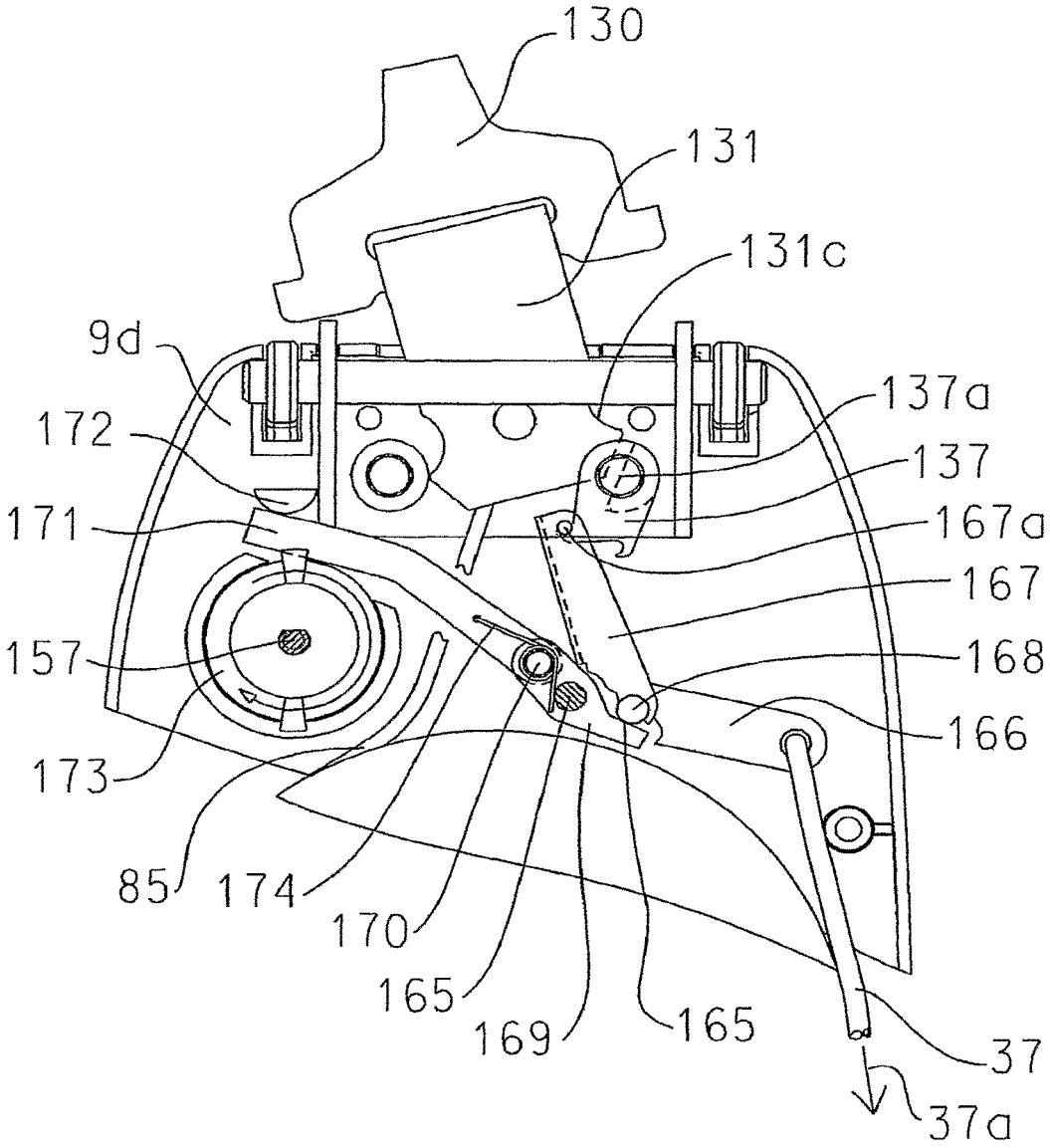
FIG. 16*b* shows a partially cut away view of the invention in FIG. 16*a* in a second level of operation.

FIGS. 16*a* and 16*b*, with reference to FIGS. 14*a*, 14*b*, 15*a* and 15*b* show an embodiment with a descent brake operated by pull cord 37 as well as the function of pull cord 37 activating the release of anchor 131. FIG. 16*a* shows the decent brake being applied when pull cord 37 is released and FIG. 16*b* shows the descent brake being released when pull cord 37 is pulled.

In FIG. 16*a*, pull cord 37 is attached to one end of lever 166 and the other end of lever 166 is attached to and can rotate about pin 165 such that when pull cord 37 is pulled, lever 166 rotates about pin 165. The position of pin 165 is fixed with respect to housing 9*d*. Lever arm 169 is also attached to and can rotate about pin 165. Pin 170 is attached to both lever arm 169 and one end of brake lever 171 so that both lever arm 169 and brake lever 171 can rotate about pin 170. Towards the other end of end of brake lever 171, brake lever 171 is constrained firstly between brake ring 173 and then, closer to the end of brake lever 171, abutment 172. The positions of abutment 172 and the central axis of brake ring 173 are fixed with respect to housing 9*d* and brake ring 173 is able to rotate within cylindrical housing 9*f* that is typically an integral part of housing 9*d*. The axis of rotation of brake ring 173 is the same as the axis of rotation of shoes 159*a* and 159*b* in FIGS. 15*a* and 15*b* and brake ring 173 has lugs 173*a* and 173*b* that locate between the ends of shoes 159*a* and 159*b* so that brake ring 173 and shoes 159*a* and 159*b* are effectively constrained to rotate together on a common axis. Pin 170 is urged to rotate in an anti-clockwise direction about pin 165 with respect to FIG. 16*a* by torsion spring 174 such that brake lever 171, because of its movement being restricted by abutment 172, is urged to bear on brake ring 173 and thereby apply load on brake shoes 159*a* and 159*b* to impede and stop their rotation such that rotation speed of drum 90 is also reduced or brought to a standstill slowing or stopping deployment of flexible elongate 85.

In FIG. 16*b*, pull cord 37 is shown in a position after having been pulled in the direction of arrow 37*a* such that lever 166 is rotated in a clockwise direction with respect to FIG. 16*b*. Pin 168 is attached to lever 166 and is raised at one end above the surface of lever 166 such that it forms an abutment that acts on lever arm 169 at contact surface 169*a* thereby tending to rotate lever arm 169 in a clockwise direction about pin 165 with respect to FIG. 16*b* so that pin 170 and the end of brake lever 171 attached to pin 170 are also rotated about pin 165 thereby allowing movement of brake lever 171 between brake ring 173 and abutment 172. Torsion spring 174 urges brake lever 171 to rotate towards abutment 172 and away from brake ring 173. Brake shoes 159*a* and 159*b* are then free to rotate so that drum 90 is also able to resume deployment of flexible elongate 85. A spring not shown in either FIG. 15*a* or 15*b* urges lever 166 to rotate in an anti-clockwise direction about pin 165 with respect to FIGS. 15*a* and 15*b* such that when pull cord 37 is released after having been pulled in the direction of arrow 37*a*, lever 166 returns to its position as shown in FIG. 15*a* and the brake is then reapplied.

FIGS. 16*a* and 16*b*, with reference to FIGS. 14*a* and 14*b*, also show a preferred embodiment for releasing anchor 131 by pulling pull cord 37. Lever 167 is attached at one end to pin 168 and is able to rotate about pin 168. Pin 168 is also attached to lever 166 such that lever 166, pin 168 and the said one end of lever 167 rotate together in a clockwise direction about pin 165 with respect to FIG. 16*a* when pull cord 37 is pulled in the direction of arrow 37*a*. A spring not shown in either FIG. 15*a* or 15*b* tends to urge lever 167 to rotate in a clockwise direction about pin 168 with respect to FIG. 16*a*. Pin 167*a* is fixed to the other end of lever 167 and engages in a first tooth of cam stop 137. Cam stop 137 rotates about axis 137*a*, the position of which is fixed with respect to housing 9*d*. Whilst arresting someone falling, cam stop engages in cut out 131*c* in anchor 131, in FIG. 14*b*, preventing anchor 131 from escaping from structure 135. When pull cord 37 is pulled in the direction of arrow 37*a*, lever 167 and pin 167*a* apply a load on the said first tooth of cam stop 137 tending to rotate cam stop 137 in an anti-clockwise direction with respect to FIG. 16*a*. After this first pulling action of pull cord 37, cam stop 137 remains engaged in cut out 131*c* in anchor 131. A spring, not shown in FIG. 16*a* or 16*b*, tends to urge cam stop 137 to rotate in a clockwise direction about its axis 137*a* with respect to the said Figures so that cam stop 137 will tend to return a first position as shown in FIG. 16*a* when pull cord 37 is released. However, when there is a predetermined level of load between someone's harness and eye 130 as would occur when a fall has been arrested, cam stop 137 would bear on cut out 131*c* in anchor 131 and the frictional resistance between the contacting surfaces of cam stop 137 and cut out 131*c* would be sufficient to stop cam 137 returning to its first position after pull cord 37 is released. In such an arrested fall situation, when pull cord 37 is released, pin 167*a* engages in a the second tooth of cam stop 137 so that another pull of pull cord 37 will rotate cam stop 137 through a further angle of rotation to an extent where there is no engagement of cam stop 137 with cut out 131*c* and anchor 131 can then escape as shown in FIG. 16*b*. This method of releasing anchor 131 avoids anchor 131 from being released unintentionally such as if pull cord 37 was accidentally snagged.

Figure 17A:
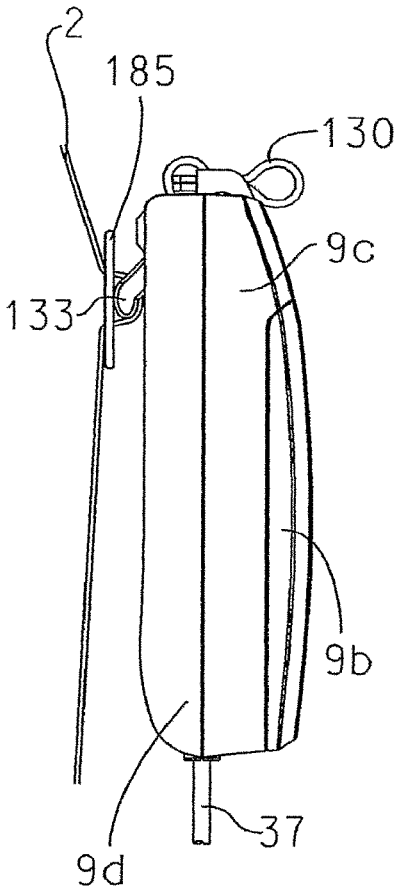
FIG. 17*a* shows a side view of the invention in FIGS. 14*a* through to FIG. 16*b* inclusive.
Figure 17B:
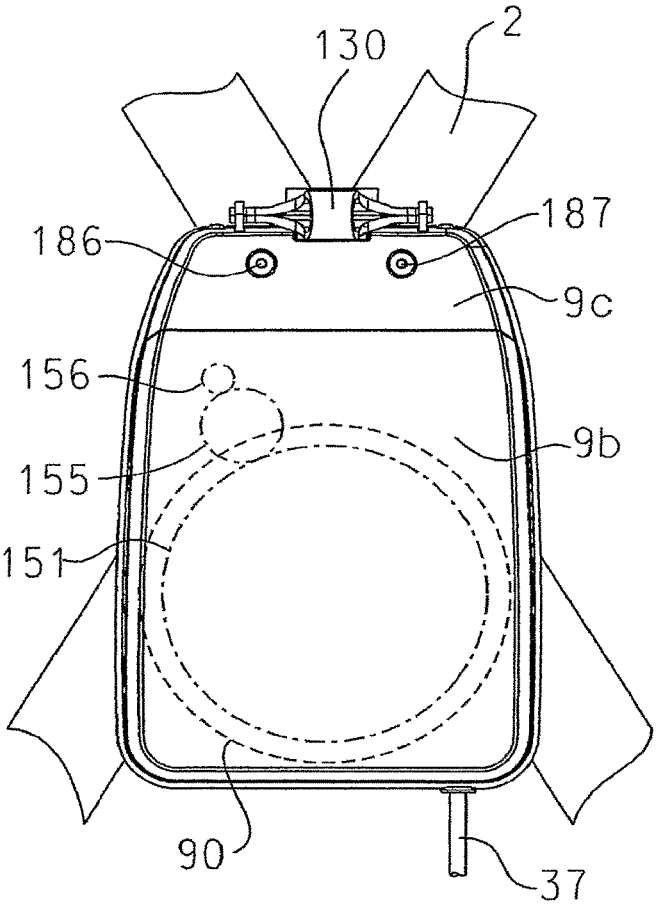
FIG. 17*b* shows a front view of the invention in FIG. 17*a;*

It should be understood that the brake as operated by pull cord 37 would typically be used after anchor 131 has been released and when a person is being descended. Such a brake function would be especially useful if someone was to descend from one level at height to another level rather than to the ground. For example, if a person's fall had been arrested on a high-rise building it would be useful if that person could descend and stop alongside a lower level to be rescued. However, in work at height sites where the descent is relatively simple the pull cord brake facility may not be needed in which case it would be more economic to provide the rescue apparatus without it. FIGS. 17*a* and 17*b* show external views of the rescue apparatus incorporating embodiments described in FIGS. 14*a*, 14*b*, 15*a* and 15*b* and also in 16*a* and 16*b* that may or may not include a brake as operated by pull cord 37.

In FIG. 17*a* the harness straps of harness 2 passing through restrictor 185 and around the harness bracket 133. Restrictor 185 is typically used with harnesses to prevent the rescue apparatus from slipping with respect to the harness. Eye 130 is normally angled at rest as shown and a karabiner is then fastened through the open loop. Bracket 133 would normally be rotated with respect to housing 9*d* as a result of the weight of the rescue apparatus. However, for convenience when the rescue apparatus is being carried in normal working conditions, it is typical for bracket 133 is to held in the position shown in FIG. 17*a* usually by one or more straps linking the lower part of housing 9*c* or 9*d* to harness bracket 133.

In FIG. 17*b*, the hidden lined circles indicate how drum 90, drive gear 151, idler gear 155 and pinion gear 156 would typically be located inside the apparatus housing components 9*b*, 9*c* and 9*d*. Fastenings 186 and 187 serve to locate structure 135 in FIGS. 14*a* and 14*b* within housings 9*c* and 9*d*. Pull cord 37 is shown without any sheathe because the use of multiple pulls to activate the release of anchor 131 will in many embodiments be sufficient to avoid accidental release before a fall has been arrested.

Reference has been made to the possibility of a person becoming incapacitated whilst being arrested from a fall to an extent that the person might be unable to operate release cord 37 manually and further reference has been made to a proposed solution whereby an extension of pull cord 37 may be dropped to the ground, or other safe level, during the process of arresting the fall enabling another person to activate the release mechanism instead and from the level to which the faller will be descended. FIGS. 18*a*, 18*b*, 18*c* and 18*d* show an example of an embodiment that provides such an extension to pull cord 37.

Figure 18A:
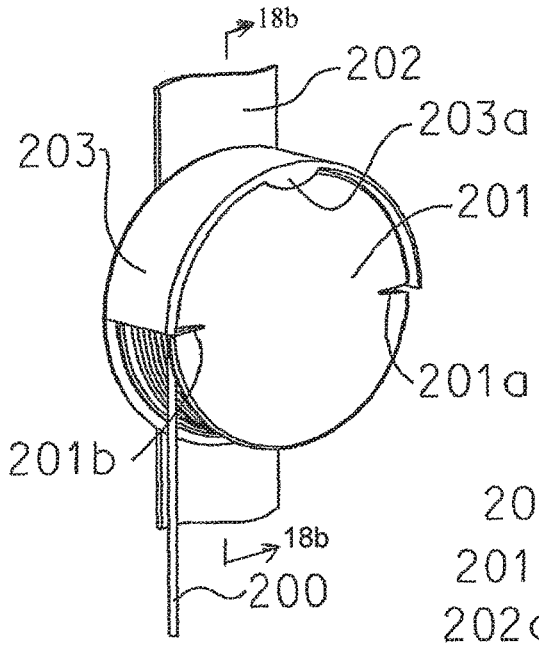
FIG. 18*a* shows a view of a part of the invention having an extension to the pull cord for operating the release of the connector that extends to the ground, or other safe level when a person is arrested from a fall.
Figure 18B:
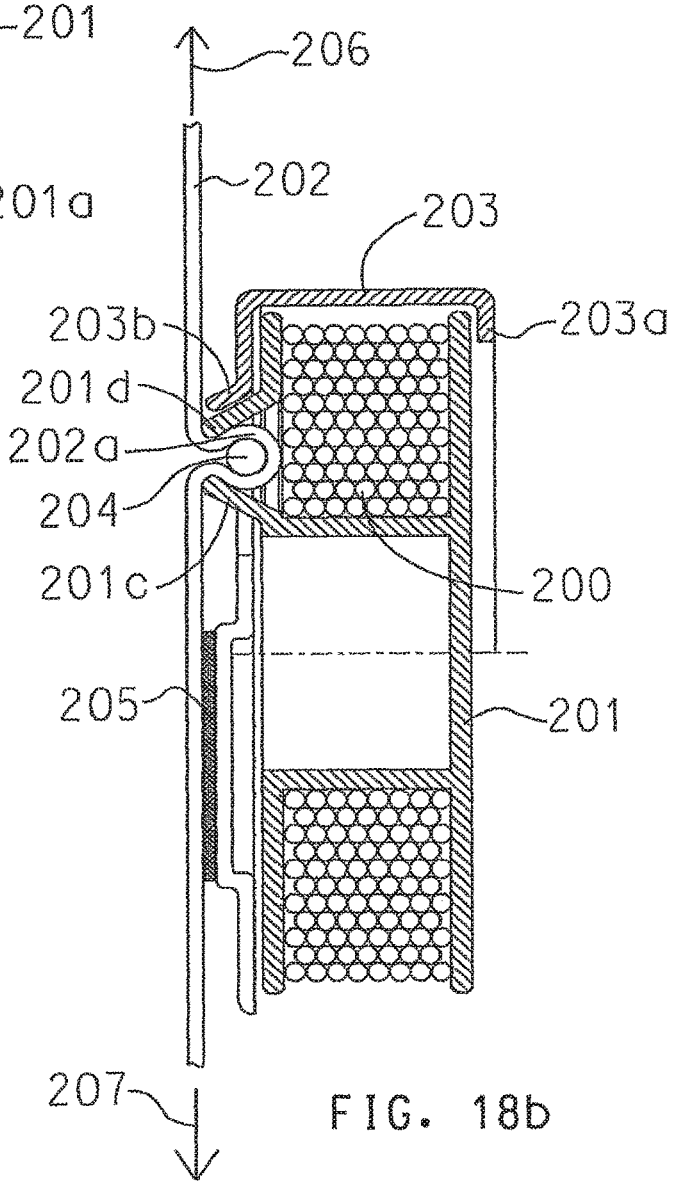
FIG. 18*b* shows a cut away view of the invention in FIG. 18*a;*
Figure 18C:
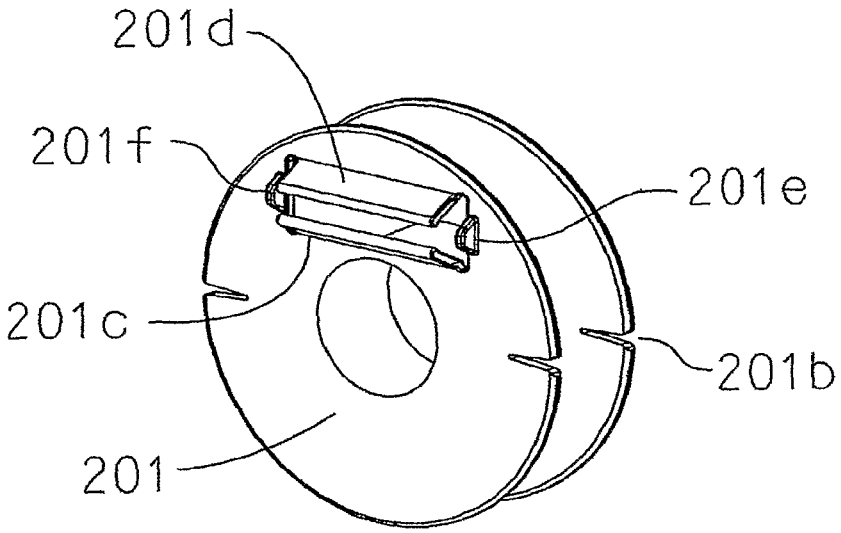
FIG. 18*c* shows a view of a first component of the invention in FIG. 18*a;*
Figure 18D:
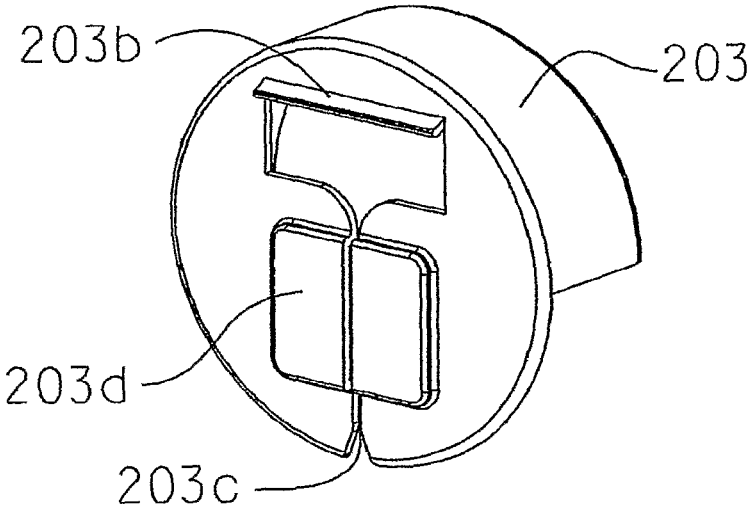
FIG. 18*d* shows a view of a second component of the invention in FIG. 18*a.*

Webbing 202 is a length of webbing strap that is typically a part of a person's harness. A loop shown as loop 202*a* in FIG. 18*b* is formed in webbing 202 with the looped axis parallel to the width of webbing 202 and loop 202*a* is then passed through a substantially rectangular aperture in one side of cylindrical drum 201. The length of the said aperture is at least as long as the width of webbing 202 and the said aperture width is bounded on each side by two opposing angled walls 201*c* and 201*d* that are attached to and typically part of drum 201. Pin 204 is a cylindrical pin whose length is typically similar to the width of webbing 202 and less than the length of the said aperture in drum 201. Pin 24 is placed within loop 202*a* with its cylindrical axis parallel to the folded axis of loop 202*a*. The width of the said aperture in drum 201 is less than the effective diameter of both pin 204 and loop 202*a* such that both pin 204 and the loop 202*a* cannot normally return through the aperture in drum 201 without first removing pin 204. Flexible elongate 200 is a length of flexible elongate that is helically wound onto drum 201 and fills drum 201 at least in the region of loop 202*a* such that both loop 202*a* and pin 204 are effectively located between flexible elongate 200 and the said aperture in drum 201. 201*e* and 201*f* in FIG. 18*c* are stops that retain pin 204 and prevent movement of pin 204 along its cylindrical axis. Cover 203 is assembled onto webbing 202 through its slot 203*c* and it is then located over drum 201 as a means for preventing flexible elongate 200 from escaping from the rim of drum 201. Abutments 203*a* and 203*b* in FIGS. 18*b* and 18*d* help to locate cover 203 into position with respect to drum 201. For convenience, cover 203 may be attached to webbing 202 at an attachment means 205 to stop it becoming easily detached from webbing 202. In practice, Velcro has been found to be suitable for attachment means 205.

Flexible elongate 200, preferably made from a rope which is strong, relatively small diameter for compactness and light weight, is securely attached to or is part of pull cord 37 in FIG. 17*b*. In practice, some modern fiber ropes with small diameters as little as 2.5 mm have been found to provide adequate strength. The length of flexible elongate 200 is typically at least as long as flexible elongate 85 wound onto drum 90 in FIG. 15*a* so that there is sufficient length to reach the ground or some other safe level after someone has been arrested from a fall.

When a person is arrested from a fall, the person's harness webbing straps are loaded significantly in tension as a result of restraining and arresting the fall. When webbing 202 is loaded beyond a predetermined level typically in the opposing directions of arrows 206 and 207 in FIG. 18*b*, angled walls 201*c* and 201*d* deflect under the load as a result of the tendency for loop 202*a* to straighten until the deflection of walls 201*c* and 201*d* is sufficient to enable both pin 204 and loop 202*a* to escape through the aperture in drum 201. When pin 204 and loop 202*a* escape, drum 201 is free to fall away from webbing 202 and to descend to the ground, or other safe level. As drum 201 falls it also rotates as a result of flexible elongate being unwound from the drum. The rotation of drum 201 during its descent has been found to be beneficial because the drum tends to roll away from any obstructions in its path. When drum 201 reaches the ground, or some other safe level, a person other than the faller can pick up the line and operate the falters rescue apparatus. If flexible elongate 200 were relatively strong small diameter rope, it could be difficult for someone to grip the rope sufficiently firmly to operate the rescue apparatus release mechanism. Slots 201*a* and 201*b* in drum 201 enable the rope to be mechanically gripped on drum 201 on the drum itself so that someone may handle drum 201 instead of flexible elongate 200 to achieve the necessary grip and pulling tension.

In any of the methods for releasing eye 11 in any of the embodiments from FIG. 1 through to FIG. 13*e* including any or all methods for releasing drum 90 in FIGS. 12*a* and 12*b* and also for releasing eye 130 and anchor 131 in FIGS. 14*a* through to 17*b*, a timer could be added so that if a release has not been manually carried out in a predetermined time period, the release mechanism could be actuated automatically. This would be useful if a person sustained injury whilst falling and/or being arrested and was therefore unable to operate the manual release control to release eye 11 or pawl stop 104. Alternatively, an additional extended manual release control may be used as provided in FIGS. 18*a*, 18*b*, 18*c* and 18*d*. Also, in any of the above embodiments, the personal height rescue apparatus could be attached to any suitable harness or safety belt and in any location with respect to the person wearing the harness or safety belt. For example, the personal height rescue apparatus could be attached at the front of a person particularly if the person was undertaking tasks that required him or her to be facing the secure anchorage provided by the fall arrest system or single point anchorage.

Any above references to manual control could also mean control by any other part of a person's body, limbs or head.

The cord in any of the pull cords referred to in any of the preceding embodiment descriptions is typically a flexible elongate and all aforementioned references to flexible elongate refer to flexible elongate that may be made from any suitable material and with any suitable cross section.

The described embodiments differ in their details but they are linked by common operating principles. Accordingly, it will be understood by the person skilled in the art that the technical features described with reference to one embodiment will normally be applicable to other embodiments.

Where the invention has been specifically described above with reference to these specific embodiments, it will be understood by the person skilled in the art that these are merely illustrative although variations are possible within the scope of the claims, which follow.

What is claimed is:

1. A height safety apparatus having a fall arrest configuration and a lowering configuration, the apparatus comprising:

a load element and an associated bracket;

a flexible elongate element fixedly secured at one end to the load element;

a release mechanism configured to directly couple the load element to the bracket in the fall arrest configuration and to uncouple the load element from the bracket to permit displacement of the bracket from the load element using the flexible elongate element in the lowering configuration;

the load element configured for attachment to one end of a safety line that has an opposite end attached to a secure anchorage when in use;

the bracket configured for attachment to a harness;

the load element coupled to the bracket in the fall arrest configuration via the release mechanism such that in use during a fall the load element and the bracket receive a fall arrest load in the fall arrest configuration via the safety line without imparting the fall arrest load on the flexible elongate element;

the load element releasable from the bracket by actuation of the release mechanism to switch to the lowering configuration wherein a lowering load is imparted on the flexible elongate element;

a speed control mechanism configured to engage the flexible elongate element to control deployment of the flexible elongate element thereby providing a controlled descent for a user harnessed to the bracket when the release mechanism permits displacement of the bracket from the load element.

2. The height safety apparatus as claimed in claim 1 wherein the bracket includes a harness section to which the harness is attached.

3. The height safety apparatus as claimed in claim 2 wherein the harness section is configured to pivotally attach the harness to the bracket about a first axis.

4. The height safety apparatus as claimed in claim 3 wherein the load element has a first portion to which the safety line is attached and a second portion which is releasably secured relative to the bracket, the two portions being able to pivot relative to each other about a second axis.

5. The height safety apparatus as claimed in claim 4 wherein the first axis is substantially parallel to the second axis.

6. The height safety apparatus as claimed in claim 1 wherein the load element is secured between a pair of spaced retention members provided on the bracket, one of which is movable to release the load element.

7. The height safety apparatus as claimed in claim 1 wherein the release mechanism comprises a pull cord adapted to release the load element.

8. The height safety apparatus as claimed in claim 1 wherein the flexible elongate element is disposed within a housing which is secured relative to the bracket.

9. The height safety apparatus as claimed in claim 8 wherein the speed control mechanism utilizes friction in order to control speed of descent.

10. The height safety apparatus as claimed in claim 8 wherein the speed control mechanism comprises one or more fixed cylinders around which the flexible elongate element is wound, wherein friction occurs between the flexible elongate element and the one or more cylinders.

11. The height safety apparatus as claimed in claim 8 wherein the flexible elongate element is wound on a drum mounted for rotation within and relative to the housing, the speed of rotation of the drum being controlled by the speed control mechanism, wherein friction occurs between the drum and the housing, a friction element being provided therebetween.

12. The height safety apparatus as claimed in claim 11 wherein the speed control mechanism includes a manual brake.

13. The height safety apparatus as claimed in claim 11 wherein the speed control mechanism includes a servo dynamic speed control mechanism.

14. The height safety apparatus as claimed in claim 11 wherein the speed control mechanism includes a centrifugal brake mechanism.

15. The height safety apparatus as claimed in claim 14 wherein the centrifugal brake mechanism comprises the drum being threadedly attached to a nut which frictionally engages a drive gear which is resiliently urged towards the nut, the drive gear driving in rotation a shoe drive having mounted thereon shoes for engagement with a cylindrical friction lining, and a friction member being provided between the drum and the housing.

16. The height safety apparatus as claimed in claim 1 wherein the release mechanism is electrically actuated.

17. The height safety apparatus as claimed in claim 16 wherein the electrical actuation is by remote control.

18. The height safety apparatus as claimed in claim 1 wherein a load limiting mechanism is provided for limiting the load on the elongate element after the load element has been released.

19. A method of improving the safety of a worker working at a height, the method comprising the steps of:

providing a height safety apparatus having a fall arrest configuration and a subsequent lowering configuration;

providing a harness to be attached to a bracket of the apparatus and to be worn by the worker;

providing a safety line securable at one end to a secure anchorage and at the other end to a load element of the apparatus, the load element directly coupled to the bracket in the fall arrest configuration such that, in the fall arrest configuration, a fall arrest load is imparted directly to the worker through the harness, the bracket, the load element and the safety line;

providing a release mechanism for uncoupling the load element from the bracket after a fall has been arrested, to switch to the lowering configuration;

providing a flexible elongate element for use in the lowering configuration, the flexible elongate element having one end fixed to the load element and being isolated from any fall arrest loads in the fall arrest configuration;

providing a speed control mechanism associated with the bracket and with the flexible elongate element, and operable in the lowering configuration to control deployment of the flexible elongate element thereby providing a controlled descent of the worker.

20. A method of operating a height safety apparatus having a fall arrest configuration and a lowering configuration comprising:

providing a load element and an associated bracket wherein the load element is configured for attachment to one end of a safety line that has an opposite end attached to a secure anchorage when in use, the load element is directly coupled to the bracket in the fall arrest configuration, and the bracket is configured for attachment to a user harness;

providing a flexible elongate element fixedly secured at one end to the load element and a speed control mechanism associated with the bracket and with the flexible elongate element;

wherein during a fall the load element and the bracket receive a fall arrest load in the fall arrest configuration via the safety line without imparting the fall arrest load on the flexible elongate element;

switching to the lowering configuration by releasing the load element from the bracket whereby a lowering load is imparted on the flexible elongate element; and operating the speed control mechanism in the lowering configuration to control deployment of the flexible elongate element thereby providing a controlled descent for a user harnessed to the bracket.

* * * * *